US008253352B2

(12) United States Patent
Liu

(10) Patent No.: US 8,253,352 B2
(45) Date of Patent: Aug. 28, 2012

(54) CIRCUITS AND METHODS FOR POWERING LIGHT SOURCES

(75) Inventor: Da Liu, Milpitas, CA (US)

(73) Assignee: O2Micro, Inc., Santa Clara, CA (US)

( * ) Notice: Subject to any disclaimer, the term of this patent is extended or adjusted under 35 U.S.C. 154(b) by 0 days.

(21) Appl. No.: 13/086,822

(22) Filed: Apr. 14, 2011

(65) Prior Publication Data

US 2011/0248648 A1 Oct. 13, 2011

Related U.S. Application Data

(63) Continuation-in-part of application No. 12/221,648, filed on Aug. 5, 2008, now Pat. No. 7,919,936.

(60) Provisional application No. 61/374,117, filed on Aug. 16, 2010.

(51) Int. Cl.
*H05B 37/02* (2006.01)

(52) U.S. Cl. ..... 315/307; 315/185 R; 315/192

(58) Field of Classification Search ..... 315/307, 315/291, 308, 185 R, 191, 227 R, 192, 240, 315/241 R, 242
See application file for complete search history.

(56) References Cited

U.S. PATENT DOCUMENTS

| | | | | |
|---|---|---|---|---|
| 6,724,156 | B2 | 4/2004 | Fregoso | |
| 7,307,614 | B2 | 12/2007 | Vinn | |
| 7,323,828 | B2 | 1/2008 | Russell et al. | |
| 7,402,961 | B2 | 7/2008 | Bayat et al. | |
| 7,528,551 | B2 * | 5/2009 | Ball | 315/247 |
| 7,649,327 | B2 | 1/2010 | Peng | |
| 7,710,047 | B2 | 5/2010 | Shteynberg et al. | |
| 7,777,430 | B2 | 8/2010 | Catalano et al. | |
| 7,781,979 | B2 * | 8/2010 | Lys | 315/185 S |
| 7,812,553 | B2 | 10/2010 | Kang et al. | |
| 7,847,486 | B2 | 12/2010 | Ng | |
| 7,880,400 | B2 * | 2/2011 | Zhou et al. | 315/247 |
| 7,906,917 | B2 | 3/2011 | Tripathi et al. | |
| 7,919,928 | B2 | 4/2011 | Ziegenfuss | |
| 8,022,634 | B2 | 9/2011 | Greenfeld | |

FOREIGN PATENT DOCUMENTS

| | | | |
|---|---|---|---|
| CN | 101155450 | A | 4/2008 |
| CN | 101222800 | A | 7/2008 |
| CN | 101430223 | A | 5/2009 |
| CN | 101636018 | A | 1/2010 |
| CN | 101668363 | A | 3/2010 |
| TW | 200738048 | A | 10/2007 |
| TW | M343351 | U | 10/2008 |
| WO | 2009022153 | A1 | 2/2009 |

* cited by examiner

*Primary Examiner* — David Hung Vu

(57) ABSTRACT

A driving circuit for powering a plurality of light-emitting diode (LED) light sources includes a power converter and a plurality of current balance controllers. The power converter receives an input voltage and provides a regulated voltage to the LED light sources. The current balance controllers coupled to the power converter control a plurality of currents through the LED light sources respectively. The current balance controllers receive a first reference signal indicative of a target average level and a second reference signal indicative of a maximum transient level, and regulate an average current of each of the currents to the target average level and a transient level of each of the currents within the maximum transient level.

20 Claims, 20 Drawing Sheets

CIRCUITS AND METHODS FOR POWERING LIGHT SOURCES

RELATED APPLICATION

This application is a continuation-in-part of the U.S. application Ser. No. 12/221,648, entitled "Driving Circuit for Powering Light Sources", filed on Aug. 5, 2008, now U.S. Pat. No. 7,919,936, which is hereby incorporated by reference in its entirety. This application also claims priority to U.S. Provisional Application No. 61/374,117, entitled "Circuits and Methods for Powering Light Sources", filed on Aug. 16, 2010, which is hereby incorporated by reference in its entirety.

BACKGROUND ART

In a display system, one or more light sources are driven by a driving circuit for illuminating a display panel. For example, in a liquid crystal display (LCD) display system with light-emitting diode (LED) backlight, an LED array is used to illuminate an LCD panel. An LED array usually includes two or more LED strings, and each LED string includes a group of LEDs connected in series. For each LED string, the forward voltage required to achieve a desired light output may vary with LED die sizes, LED die material, LED die lot variations, and temperature. Therefore, in order to generate desired light outputs with a uniform brightness, driving circuits are used to regulate the current flowing through each LED string to be substantially the same.

FIG. 1 shows a block diagram of a conventional LED driving circuit 100. The LED driving circuit 100 includes a DC/DC converter 102 for converting an input DC voltage VIN to a desired output DC voltage VOUT for powering LED strings 108_1, 108_2, . . . 108_*n*. Each of the LED strings 108_1, 108_2, . . . 108_*n* is respectively coupled to a linear LED current balance controller 106_1, 106_2, . . . 106_*n* in series. A selection circuit 104 receives monitoring signals from current sensing resistors RSEN_1, RSEN_2, . . . RSEN_N and generates a feedback signal. The DC/DC converter 102 adjusts the output DC voltage VOUT based on the feedback signal. Operational amplifiers 110_1, 110_2, . . . 110_N in the linear LED current balance controllers compare the monitoring signals from current sensing resistors RSEN_1, RSEN_2, . . . RSEN_N with a reference signal REF respectively, and generate control signals to adjust the resistance of transistors Q1, Q2, . . . QN respectively in a linear mode. In other words, the conventional LED driving circuit 100 controls transistors Q1, Q2, . . . QN linearly to adjust the LED currents flowing through the LED strings 108_1, 108_2, . . . 108_N respectively. However, this solution may not be suitable for systems requiring relatively large LED current because of the larger amount of heat generated by the transistors Q1, Q2, . . . QN. As such, the power efficiency of the system may be decreased due to the power dissipation.

FIG. 2 shows a block diagram of another conventional LED driving circuit 200. In FIG. 2, each LED string is coupled to a dedicated DC/DC converter 202_1, 202_2, . . . 202_N respectively. Each DC/DC converter 202_1, 202_2, . . . 202_N receives a feedback signal from a corresponding current sensing resistor RSEN_1, RSEN_2, . . . RSEN_N and adjusts an output voltage VOUT_1, VOUT_2, . . . VOUT_N respectively according to a corresponding LED current demand. One of the drawbacks of this solution is that the system cost can be increased if there are a large number of LED strings, since a dedicated DC/DC converter is required for each LED string.

SUMMARY

A driving circuit for powering a plurality of light-emitting diode (LED) light sources includes a power converter and a plurality of current balance controllers. The power converter receives an input voltage and provides a regulated voltage to the LED light sources. The current balance controllers coupled to the power converter control a plurality of currents through the LED light sources respectively. The current balance controllers receive a first reference signal indicative of a target average level and a second reference signal indicative of a maximum transient level, and regulate an average current of each of the currents to the target average level and a transient level of each of the currents within the maximum transient level.

BRIEF DESCRIPTION OF THE DRAWINGS

Features and advantages of embodiments of the invention will become apparent as the following detailed description proceeds, and upon reference to the drawings, where like numerals depict like elements, and in which.

DETAILED DESCRIPTION

Reference will now be made in detail to the embodiments of the present invention. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention. In the embodiments of the present invention, LED strings are used as examples of light sources for illustration purposes. However, the driving circuits disclosed in the present invention can be used to drive various loads which are not limited to LED strings.

Embodiments in accordance with the present invention provide circuits and methods for powering LED light sources. A driving circuit regulates a current through an LED light source by controlling a switch in series with the LED light source. The switch can be switched on and off alternately according to a driving signal. The duty cycle of the driving signal is determined based on a monitoring signal indicating the current flowing through the LED light source. More specifically, in one embodiment, the duty cycle of the driving signal is determined according to an error signal which indicates a difference between an average of the monitoring signal and a first reference. The amplitude of the driving signal is determined by a difference between the monitoring signal and a second reference. The first reference determines a target average current through the LED light source. The second reference determines a maximum transient current through the LED light source. As a result, an average current flowing through each LED light source can be adjusted to be substantially the same as the target average current. A transient current flowing through each LED light source can be controlled within the maximum transient current. Advantageously, the driving circuit has an improved power efficiency and do not require multiple dedicated power converters.

Figure 1:
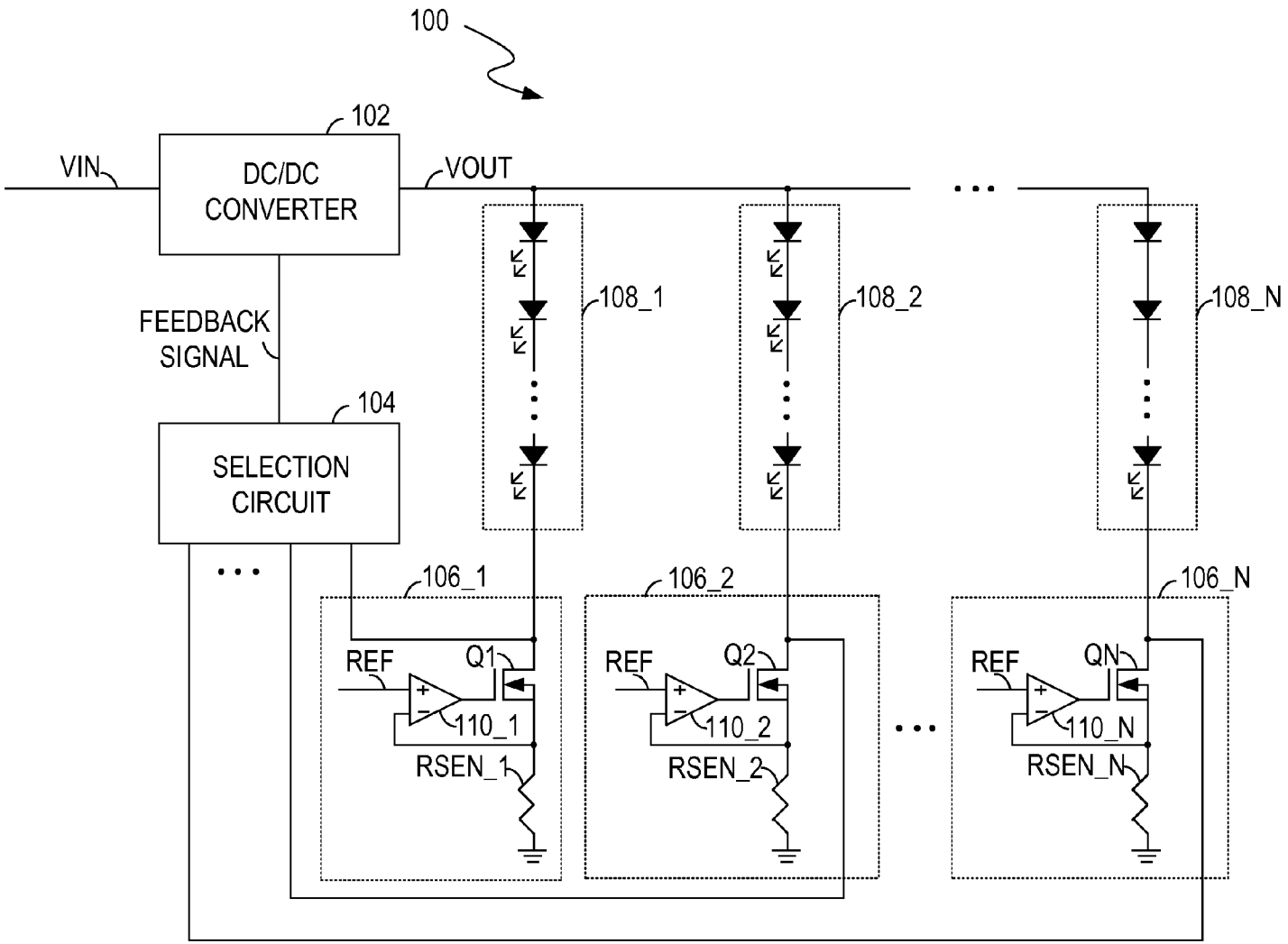
FIG. 1 PRIOR ART
FIG. 1 shows a schematic diagram of a conventional LED driving circuit.
Figure 2:
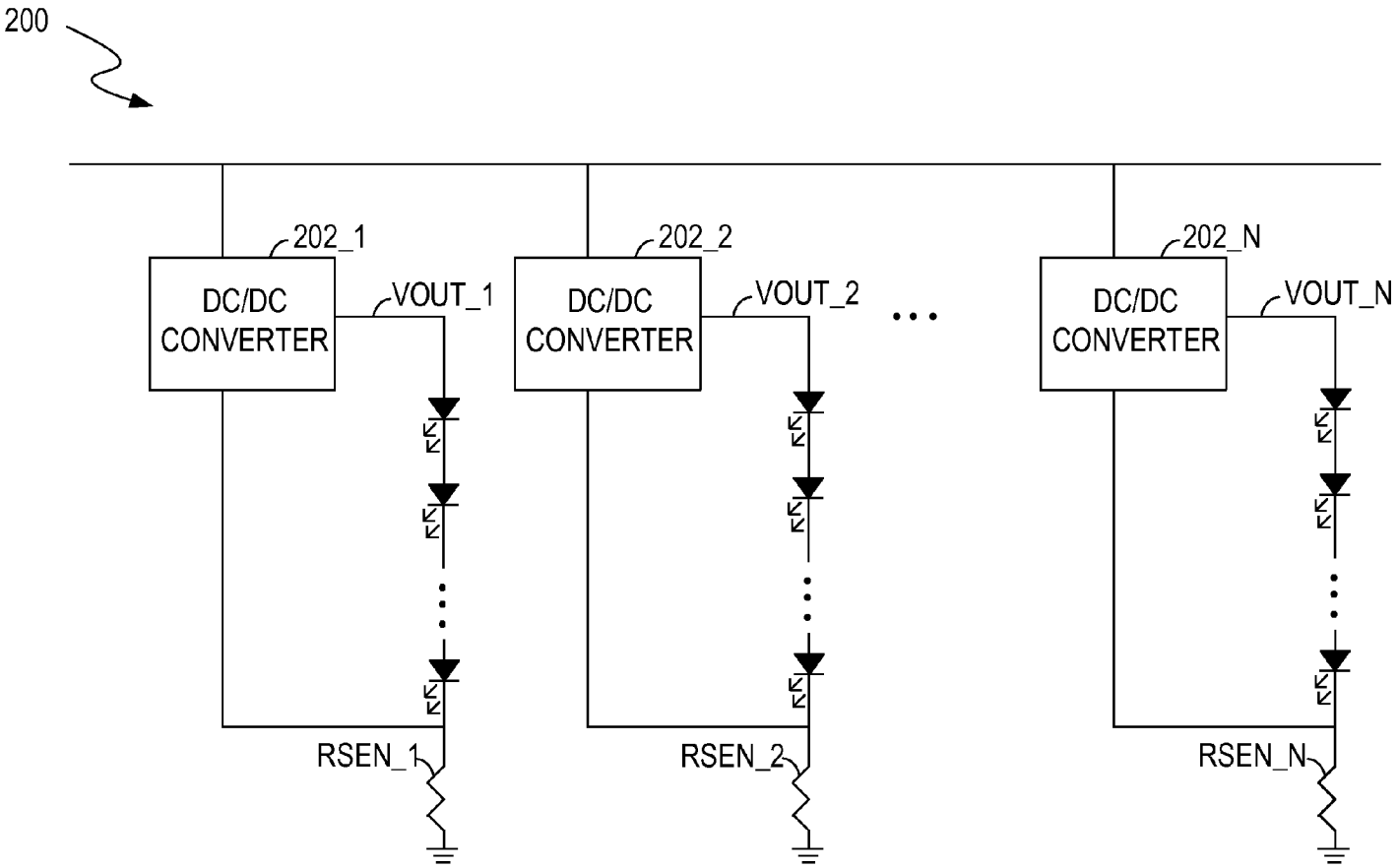
FIG. 2 PRIOR ART
FIG. 2 shows a schematic diagram of another conventional LED driving circuit.
Figure 3:
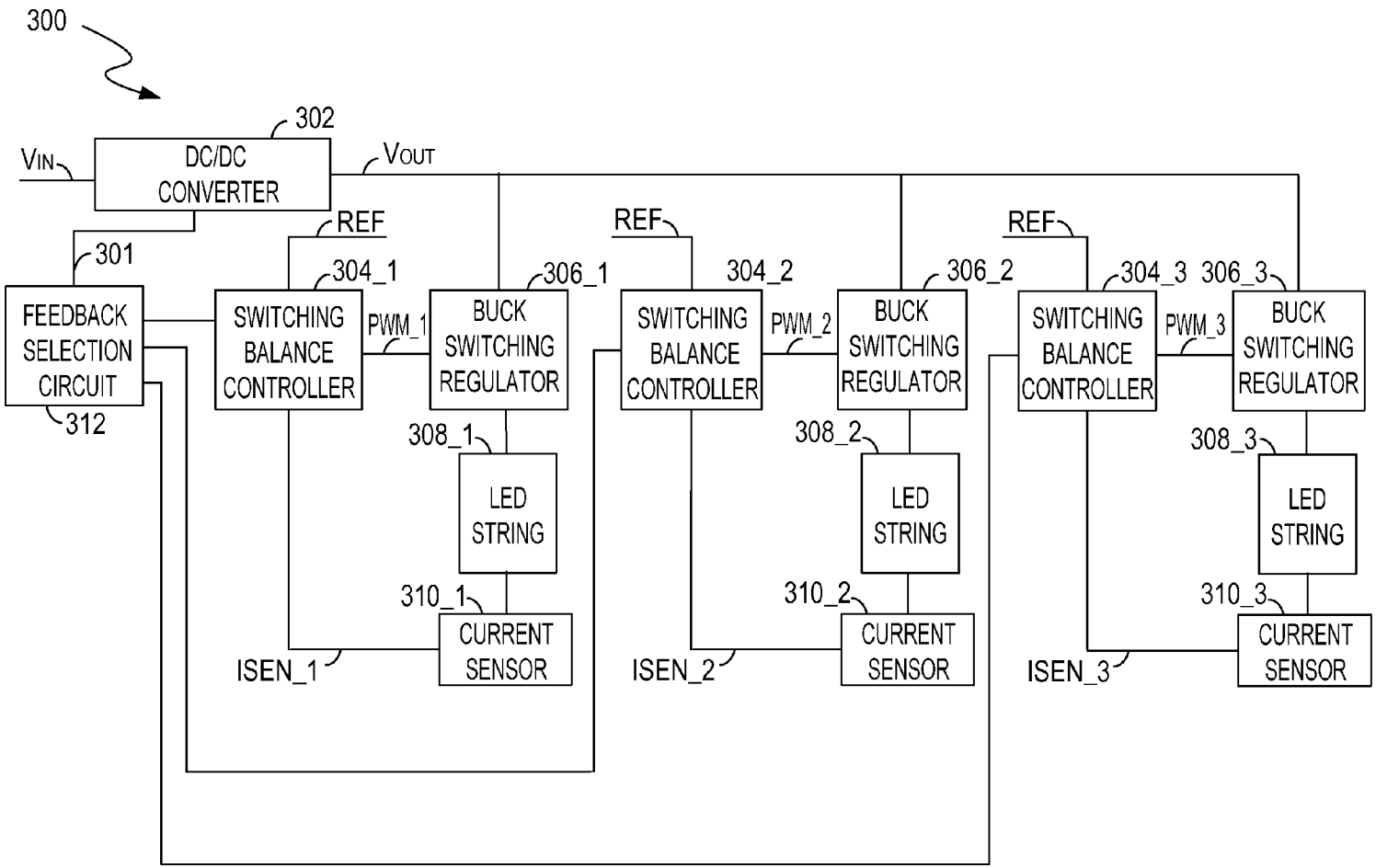
FIG. 3 shows a block diagram of an LED driving circuit, in accordance with one embodiment of the present invention.

FIG. 3 shows a block diagram of an LED driving circuit 300, in accordance with one embodiment of the present invention. The LED driving circuit 300 includes a power converter (e.g., a DC/DC converter 302) for providing a regulated voltage to a plurality of LED strings. In the example of FIG. 3, there are three LED strings 308_1, 308_2, and 308_3. However, other numbers of the LED strings can be included in the LED driving circuit 300. The LED driving circuit 300 also includes a plurality of switching regulators (e.g., a plurality of buck switching regulators) 306_1, 306_2, and 306_3 coupled to the DC/DC converter 302 for adjusting forward voltages of the LED strings 308_1, 308_2, and 308_3 respectively. The LED driving circuit 300 also includes a plurality of switching balance controllers 304_1, 304_2 and 304_3 for controlling the buck switching regulators 306_1, 306_2, and 306_3 respectively. A feedback selection circuit 312 can be coupled between the DC/DC converter 302 and the buck switching regulators 306_1, 306_2, and 306_3 for adjusting the output voltage of the DC/DC converter 302. A plurality of current sensors 310_1, 310_2 and 310_3 are coupled to the LED strings 308_1, 308_2, and 308_3 respectively for providing a plurality of monitoring signals ISEN_1, ISEN_2 and ISEN_3 which indicate LED currents flowing through the LED strings 308_1, 308_2, and 308_3 respectively, in one embodiment.

In operation, the DC/DC converter 302 receives an input voltage $V_{IN}$ and provides a regulated voltage $V_{OUT}$. Each of the switching balance controllers 304_1, 304_2 and 304_3 receives the same reference signal REF indicating a target current flowing through each LED string 308_1, 308_2, and 308_3, and receives a corresponding monitoring signal ISEN_1, ISEN_2, ISEN_3 from a corresponding current sensor, in one embodiment. Switching balance controllers 304_1, 304_2 and 304_3 generate pulse modulation signals (e.g., pulse-width modulation signals) PWM_1, PWM_2, and PWM_3 respectively according to the reference signal REF and a corresponding monitoring signal, and adjust voltage drops across buck switching regulators 306_1, 306_2, and 306_3 with the pulse modulation signals PWM_1, PWM_2, and PWM_3 respectively, in one embodiment.

The buck switching regulators 306_1, 306_2, and 306_3 are controlled by the switching balance controllers 304_1, 304_2 and 304_3 respectively to adjust voltage drops across the buck switching regulators 306_1, 306_2, and 306_3. For each of the LED strings 308_1, 308_2, and 308_3, an LED current flows through the LED string according to a forward voltage of the LED string (the voltage drop across the LED string). The forward voltage of the LED string can be proportional to a difference between the regulated voltage $V_{OUT}$ and a voltage drop across a corresponding switching regulator. As such, by adjusting the voltage drops across the switching regulators 306_1, 306_2, and 306_3 with the switching balance controller 304_1, 304_2 and 304_3 respectively, the forward voltages of the LED strings 308_1, 308_2, and 308_3 can be adjusted accordingly. Therefore, the LED currents of the LED strings 308_1, 308_2, and 308_3 can also be adjusted accordingly. In one embodiment of the invention, the switching balance controllers 304_1, 304_2 and 304_3 adjust the voltage drops across the switching regulators 306_1, 306_2, and 306_3 respectively such that all the LED currents are substantially the same as the target current. Here the term "substantially the same" in the present disclosure means that the LED currents can vary but within a range such that all of the LED strings can generate desired light outputs with a relatively uniform brightness.

The switching balance controllers 304_1, 304_2 and 304_3 are also capable of generating a plurality of error signals according to the monitoring signals ISEN_1, ISEN_2, and ISEN_3 and the reference signal REF. Each of the error signals can indicate a forward voltage required by a corresponding LED string to produce an LED current which is substantially the same as the target current. The feedback selection circuit 312 can receive the error signals and determine which LED string has a maximum forward voltage. For each of the LED strings 308_1, 308_2, and 308_3, the corresponding forward voltage required to achieve a desired light output can be different. The term "maximum forward voltage" used in the present disclosure indicates the largest forward voltage among the forward voltages of the LED strings 308_1, 308_2, and 308_3 when the LED strings 308_1, 308_2, and 308_3 can generate desired light outputs with a relatively uniform brightness, in one embodiment. The feedback selection circuit 312 generates a feedback signal 301 indicating the LED current of the LED string having the maximum forward voltage. Consequently, the DC/DC converter 302 adjusts the regulated voltage $V_{OUT}$ according to the feedback signal 301 to satisfy a power need of the LED string having the maximum forward voltage, in one embodiment. For example, the DC/DC converter 302 increases $V_{OUT}$ to increase the LED current of the LED string having the maximum forward voltage, or decreases $V_{OUT}$ to decrease the LED current of the LED string having the maximum forward voltage.

Figure 4:
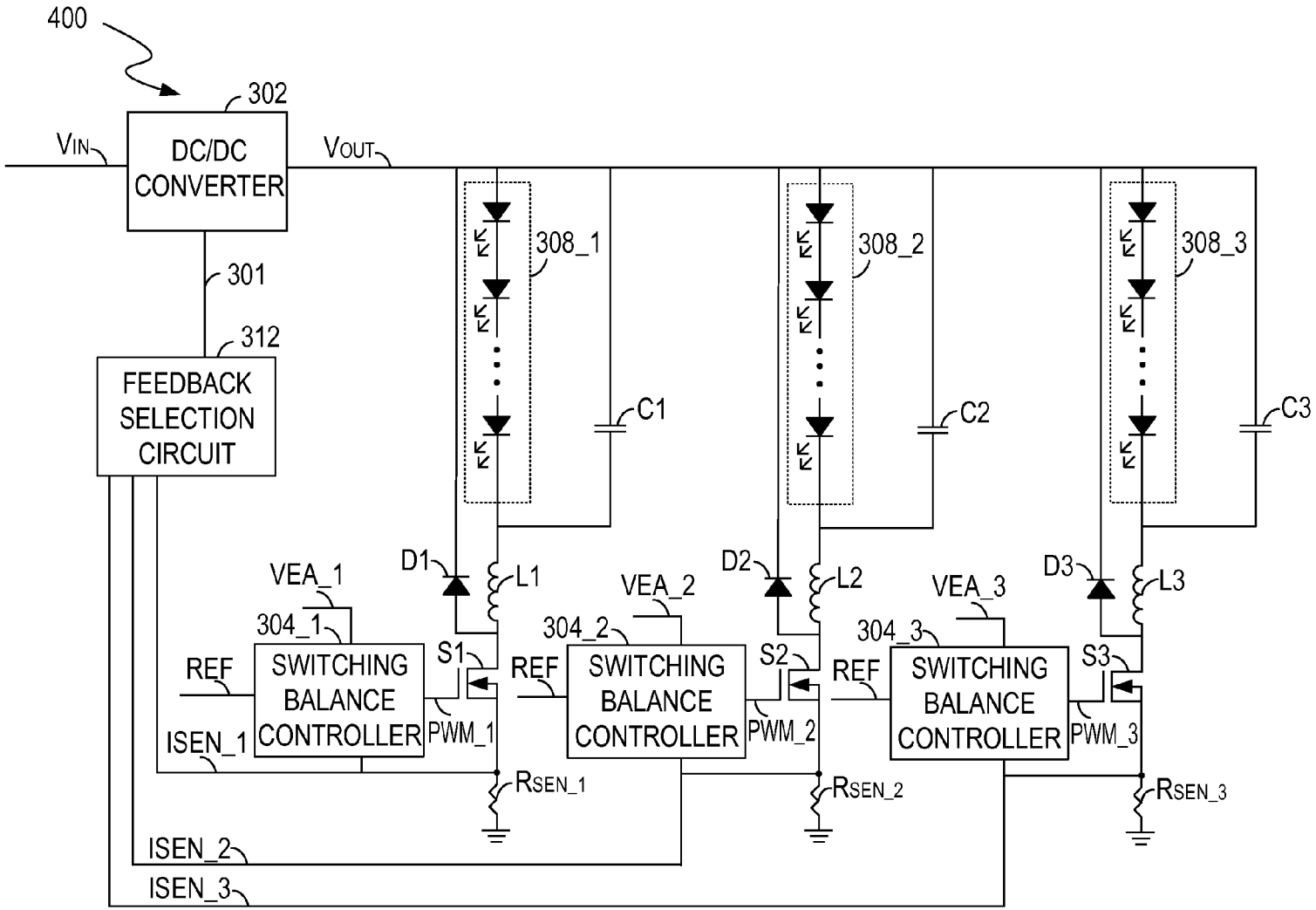
FIG. 4 shows a schematic diagram of an LED driving circuit, in accordance with one embodiment of the present invention.

FIG. 4 shows a schematic diagram of an LED driving circuit 400 with a common anode connection, in accordance with one embodiment of the present invention. FIG. 4 is described in combination with FIG. 3. Elements labeled the same as in FIG. 3 have similar functions and will not be detailed described herein. In the example of FIG. 4, there are three LED strings 308_1, 308_2, and 308_3. However, other numbers of the LED strings can be included in the LED driving circuit 400.

The LED driving circuit 400 utilizes a plurality of switching regulators (e.g., buck switching regulators) to adjust forward voltages of the LED strings 308_1, 308_2, and 308_3 based on a reference signal REF and a plurality of monitoring signals ISEN_1, ISEN_2, and ISEN_3 which indicate LED currents of the LED strings 308_1, 308_2, and 308_3 respectively. The monitoring signals ISEN_1, ISEN_2, and ISEN_3 can be obtained from a plurality of current sensors. In the example of FIG. 4, each current sensor includes a current sensing resistor $R_{SEN_i}$ (i=1, 2, 3).

In one embodiment, each buck switching regulator includes a inductor Li (i=1, 2, 3), a diode Di (i=1, 2, 3), a capacitor Ci (i=1, 2, 3) and a switch Si (i=1, 2, 3). The inductor Li is coupled in series with a corresponding LED string 308_*i* (i=1, 2, 3). The diode Di is coupled in parallel with the serially connected LED string 308_*i* and the inductor Li. The capacitor Ci is coupled in parallel with a corresponding LED string 308_*i*. The switch Si is coupled between a corresponding inductor Li and ground. Each buck switching regulator is controlled by a pulse modulation signal, e.g., a pulse-width modulation (PWM) signal PWM_i (i=1, 2, 3), generated by a corresponding switching balance controller 304_*i* (i=1, 2, 3).

The LED driving circuit 400 also includes a DC/DC converter 302 for providing a regulated voltage, and a feedback selection circuit 312 for providing a feedback signal 301 to adjust the regulated voltage of the DC/DC converter 302, in order to satisfy a power need of an LED string having a maximum forward voltage.

In operation, the DC/DC converter 302 receives an input voltage $V_{IN}$ and provides a regulated voltage $V_{OUT}$. The switching balance controller 304_*i* controls the conductance status of a corresponding switch Si with a PWM signal PWM_i (i=1, 2, 3).

During a first time period when the switch Si is turned on, an LED current flows through the LED string 308_*i*, the inductor Li, the switch Si, and the current sensing resistor $R_{SEN_i}$ to ground. The forward voltage of the LED string 308_*i* is proportional to a difference between the regulated voltage $V_{OUT}$ and a voltage drop across a corresponding switching regulator, in one embodiment. During this first time period, the DC/DC converter 302 powers the LED string 308_*i* and charges the inductor Li simultaneously by the regulated voltage $V_{OUT}$. During a second time period when the switch Si is turned off, an LED current flows through the LED string 308_*i*, the inductor Li and the diode Di. During this second time period, the inductor Li discharges to power the LED string 308_*i*.

In order to control the conductance status of the switch Si, the switching balance controller 304_*i* generates a corresponding PWM signal PWM_i having a duty cycle D. The inductor Li, the diode Di, the capacitor Ci and the switch Si constitute a buck switching regulator, in one embodiment. Neglecting the voltage drop across the switch Si and the voltage drop across the current sensing resistor $R_{SEN_i}$, the forward voltage of the LED string 308_*i* is equal to $V_{OUT}$*D, in one embodiment. Therefore, by adjusting the duty cycle D of the PWM signal PWM_i, the forward voltage of a corresponding LED string 308_*i* can be adjusted accordingly.

The switching balance controller 304_*i* receives a reference signal REF indicating a target current and receives a monitoring signal ISEN_i (i=1, 2, 3) indicating an LED current of the LED string 308_*i*, and generates an error signal VEA_i (i=1, 2, 3) based on the reference signal REF and the monitoring signal ISEN_i to adjust the duty cycle D of the PWM signal PWM_i accordingly so as to make the LED current substantially the same as the target current, in one embodiment. More specifically, the switching balance controller 304_*i* generates the error signal VEA_i by comparing an average of the monitoring signal ISEN_i when the switch Si is on and the reference signal REF, in one embodiment. The error signal VEA_i can indicate the amount of the forward voltage required by a corresponding LED string 308_*i* to produce an LED current which is substantially the same as the target current. In one embodiment, a larger VEA_i indicates that the corresponding LED string 308_*i* needs a larger forward voltage. The switching balance controller 304_*i* in FIG. 4 is discussed in detail in relation to FIG. 5.

In one embodiment, the feedback selection circuit 312 receives the error signals VEA_i respectively from the switching balance controllers 304_*i*, and determines which LED string has a maximum forward voltage when all the LED currents are substantially the same. The feedback selection circuit 312 can also receive the monitoring signals ISEN_i from the current sensing resistors $R_{SEN_i}$.

The feedback selection circuit 312 generates a feedback signal 301 indicating an LED current of the LED string having the maximum forward voltage according to the error signals VEA_i and/or the monitoring signals ISEN_i. The DC/DC converter 302 adjusts the regulated voltage $V_{OUT}$ according to the feedback signal 301 to satisfy a power need of the LED string having the maximum forward voltage. As long as $V_{OUT}$ can satisfy the power need of the LED string having the maximum forward voltage, $V_{OUT}$ can also satisfy the power needs of any other LED string, in one embodiment. Therefore, all the LED strings can be supplied with enough power to generate desired light outputs with a relatively uniform brightness.

Figure 5:
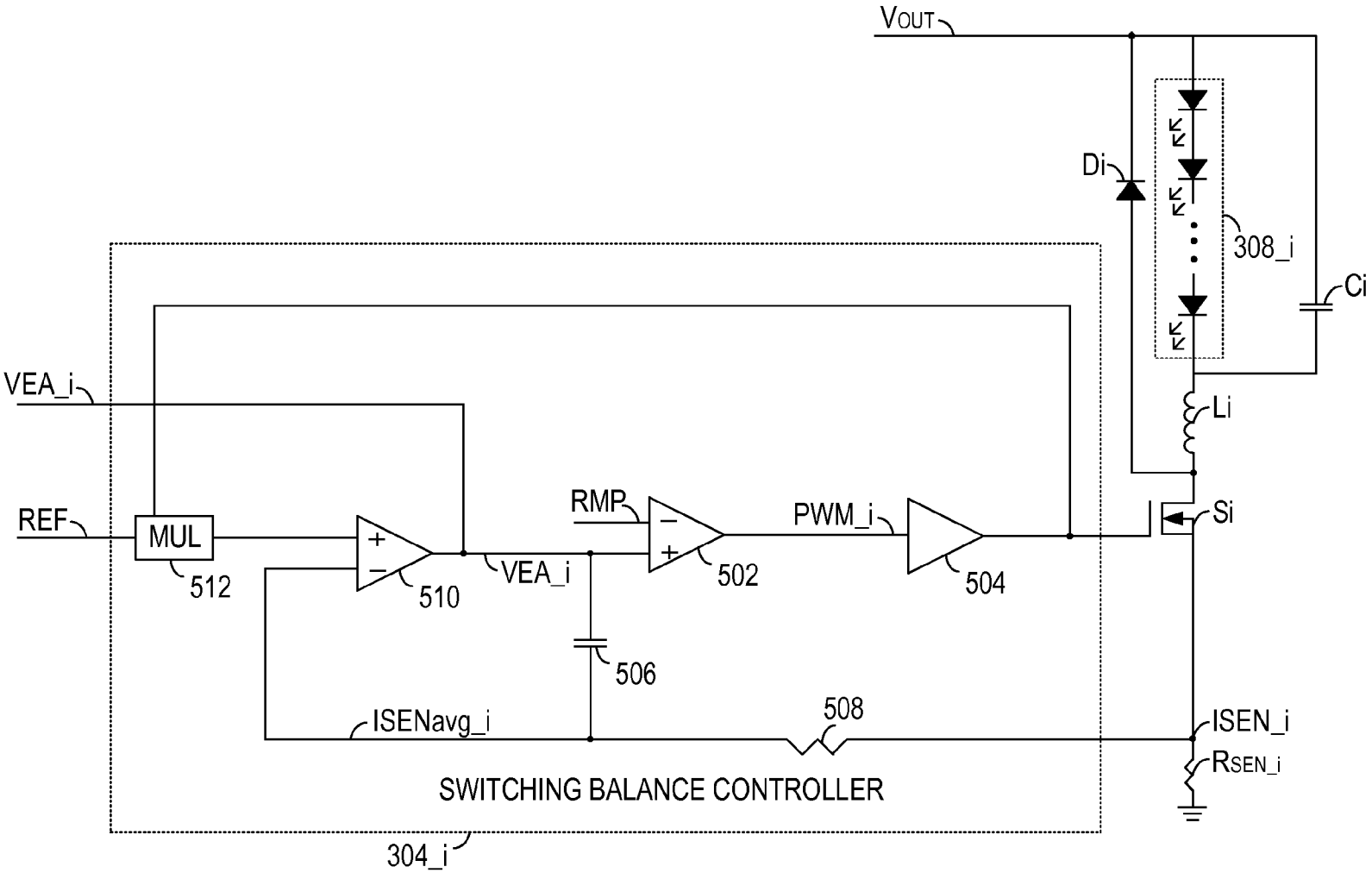
FIG. 5 shows an example of a switching balance controller shown in FIG. 4 and the connection between the switching balance controller and a corresponding LED string, in accordance with one embodiment of the present invention.

FIG. 5 illustrates an example of a switching balance controller 304_*i* shown in FIG. 4 and the connection between the switching balance controller 304_*i* and a corresponding LED string 308_*i*. FIG. 5 is described in combination with FIG. 4.

In the example of FIG. 5, the switching balance controller 304_*i* includes an integrator for generating the error signal VEA_i, and a comparator 502 for comparing the error signal VEA_i with a ramp signal RMP to generate the PWM signal PWM_i. The integrator is shown as a resistor 508 coupled to the current sensing resistor $R_{SEN_i}$, an error amplifier 510, a capacitor 506 with one end coupled between the error amplifier 510 and the comparator 502 while the other end coupled to the resistor 508, in one embodiment.

The error amplifier 510 receives two inputs. The first input is a product of the reference signal REF multiplied with the PWM signal PWM_i by a multiplier 512. The second input is a signal ISENavg_i indicating the average of the monitoring signal ISEN_i from the current sensing resistor $R_{SEN_i}$ when the switch Si is on. The output of the error amplifier 510 is the error signal VEA_i.

At the comparator 502, the error signal VEA_i is compared with the ramp signal RMP to generate the PWM signal PWM_i and to adjust the duty cycle of the PWM signal PWM_i. The PWM signal PWM_i is passed through a buffer 504 and is used to control the conductance status of a switch Si in a corresponding buck switching regulator. During a first time period when the error signal VEA_i is higher than the ramp signal RMP, the PWM signal PWM_i is set to logic high and the switch Si is turned on, in one embodiment. During a second time period when the error signal VEA_i is lower than the ramp signal RMP, the PWM signal PWM_i is set to logic low and the switch Si is turned off, in one embodiment.

As such, by comparing the error signal VEA_i with the ramp signal RMP, the duty cycle D of the PWM signal PWM_i can be adjusted accordingly. In one embodiment, the duty cycle D of the PWM signal PWM_i increases when the level of error signal VEA_i increases and the duty cycle D of the PWM signal PWM_i decreases when the level of error signal VEA_i decreases. At the same time, the forward voltage of the LED string is adjusted accordingly by the PWM signal PWM_i. In one embodiment, a PWM signal with a larger duty cycle results in a larger forward voltage across the LED string 308_*i* and a PWM signal with a smaller duty cycle results in a smaller forward voltage across the LED string 308_*i*.

In one embodiment, the feedback selection circuit 312 shown in FIG. 4 receives VEA_1, VEA_2, and VEA_3 and determines which LED string has a maximum forward voltage by comparing VEA_1, VEA_2 and VEA_3. For example, if VEA_1<VEA_2<VEA_3, the feedback selection circuit 312 determines that LED string 308_3 has the maximum forward voltage, and generates a feedback signal 301 indicating the LED current of LED string 308_3. The DC/DC converter 302 shown in FIG. 4 receives the feedback signal 301 and adjusts the regulated voltage $V_{OUT}$ accordingly to satisfy a power need of the LED string 308_3. As long as $V_{OUT}$ can satisfy the power need of the LED string 308_3, it can also satisfy the power needs of the LED string 308_1 and the LED string 308_2. Therefore, all the LED strings 308_1, 308_2 and 308_3 can be supplied with enough power to generate desired light outputs with a relatively uniform brightness.

Figure 6:
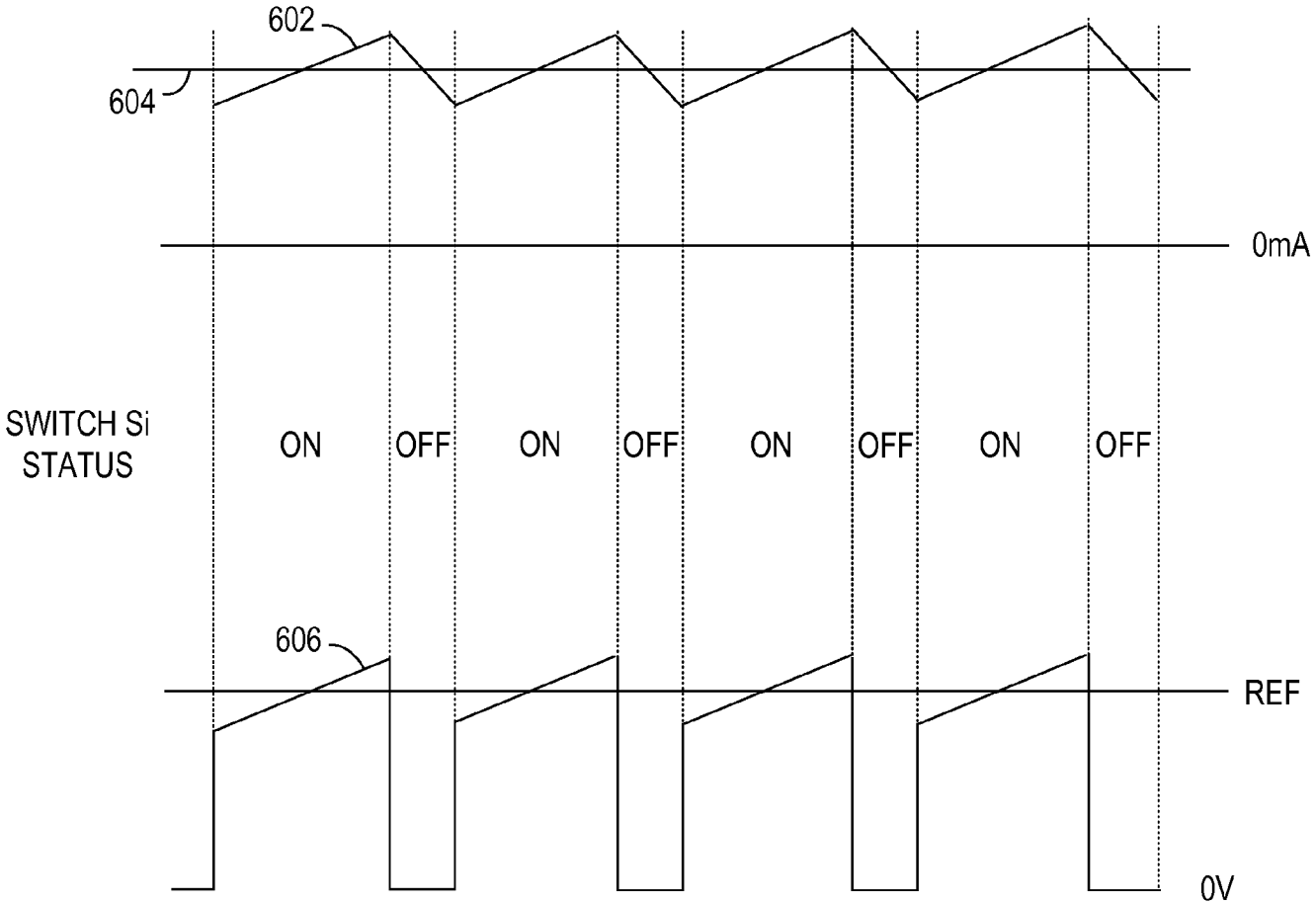
FIG. 6 illustrates the relationship among an LED current, an inductor current, and a voltage waveform at the current sensing resistor shown in FIG. 5, in accordance with one embodiment of the present invention.

FIG. 6 illustrates an example of relationship among an LED current 604 of the LED string 308_*i*, an inductor current 602 of the inductor Li, and a voltage waveform 606 across the current sensing resistor $R_{SEN_i}$. FIG. 6 is described in combination with FIG. 4 and FIG. 5.

During the time period when the switch Si is turned on, the DC/DC converter 302 powers the LED string 308_*i* and charges the inductor Li by the regulated voltage $V_{OUT}$. When the switch Si is turned on by PWM_i, the inductor current 602 flows through the switch Si and the current sensing resistor $R_{SEN_i}$ to ground. The inductor current 602 increases when the switch Si is on, and the voltage waveform 606 across the current sensing resistor $R_{SEN_i}$ increases simultaneously.

During the time period when the switch Si is turned off, the inductor Li discharges and the LED string 308_*i* is powered by the inductor Li. When the switch Si is turned off by PWM_i, the inductor current 602 flows through the inductor Li, the diode Di and the LED string 308_*i*. The inductor current 602 decreases when the switch Si is off. Since there is no current flowing through the current sensing resistor $R_{SEN_i}$, the voltage waveform 606 across the current sensing resistor $R_{SEN_i}$ decreases to 0.

In one embodiment, the capacitor Ci coupled in parallel with the LED string 308_*i* filters the inductor current 602 and yields a substantially constant LED current 604 whose level is an average level of the inductor current 602.

Accordingly, the LED current 604 of the LED string 308_*i* can be adjusted towards the target current. The average voltage across the current sensing resistor $R_{SEN_i}$ when the switch Si is turned on is equal to the voltage of the reference signal REF, in one embodiment.

Figure 7:
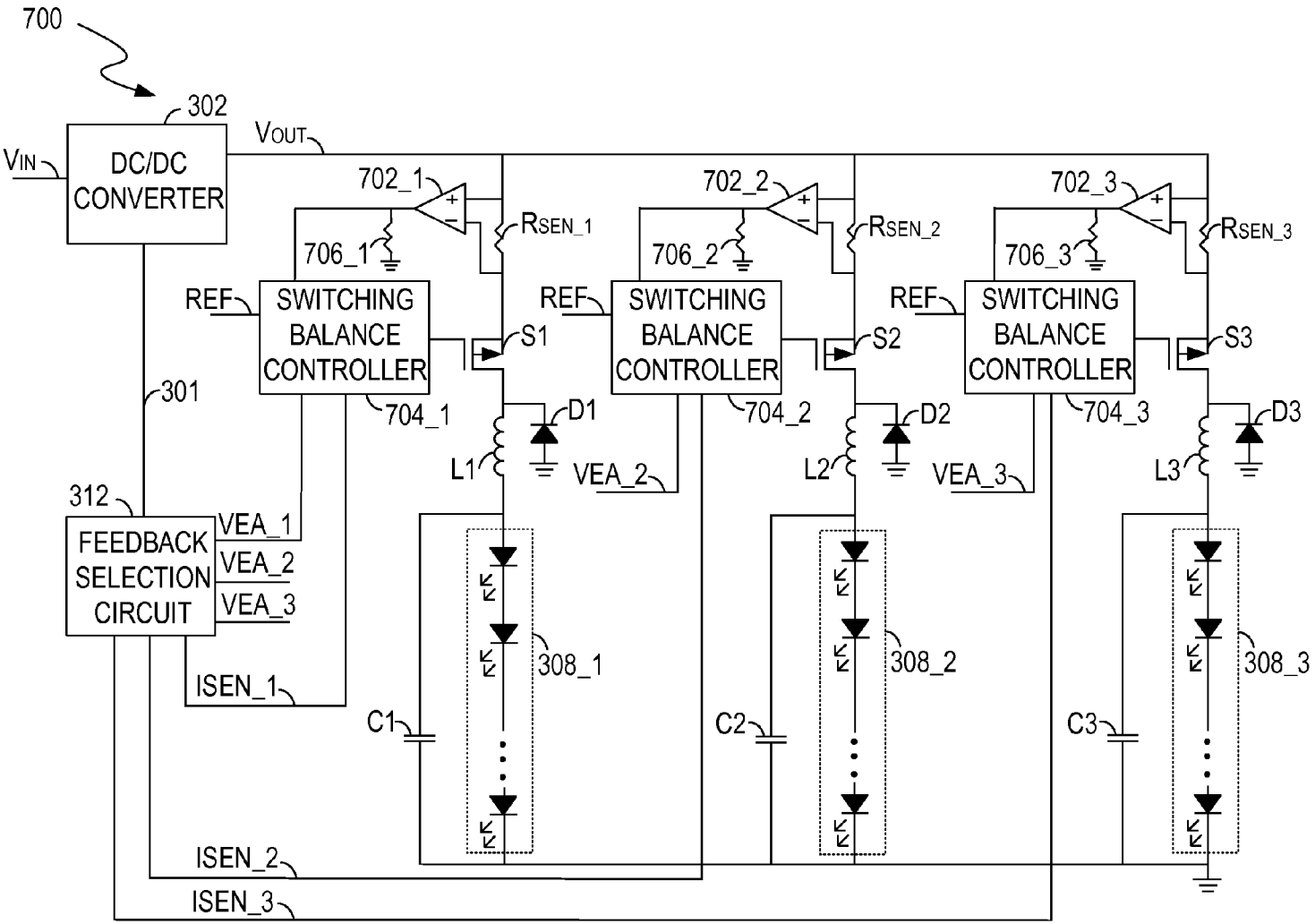
FIG. 7 shows a schematic diagram of an LED driving circuit, in accordance with one embodiment of the present invention.

FIG. 7 shows a schematic diagram of an LED driving circuit 700 with a common cathode connection, in accordance with one embodiment of the present invention. Elements labeled the same as in FIG. 4 have similar functions and will not be detailed described herein. In the example of FIG. 7, there are three LED strings 308_1, 308_2, and 308_3. However, other numbers of the LED strings can be included in the LED driving circuit 700.

Similar to the LED driving circuit 400 shown in FIG. 4, the LED driving circuit 700 utilizes a plurality of switching regulators (e.g., buck switching regulators) to adjust forward voltages of the LED strings 308_1, 308_2, and 308_3 based on a reference signal REF and a plurality of monitoring signals ISEN_1, ISEN_2, and ISEN_3 which indicate the LED currents of the LED strings 308_1, 308_2, and 308_3 respectively. The monitoring signals ISEN_1, ISEN_2, and ISEN_3 can be obtained from a plurality of current sensors. In the example of FIG. 7, each current sensor includes a current sensing resistor $R_{SEN_i}$ (i=1, 2, 3), a differential amplifier 702_*i* (i=1, 2, 3), and a resistor 706_*i* (i=1, 2, 3). The current sensing resistor $R_{SEN_i}$ is coupled to a corresponding LED string 308_*i* in series. The differential amplifier 702_*i* is coupled between the current sensing resistor $R_{SEN_i}$ and a switching balance controller 704_*i*. The resistor 706_*i* is coupled between the differential amplifier 702_*i* and ground.

Each buck switching regulator includes a inductor Li (i=1, 2, 3), a diode Di (i=1, 2, 3), a capacitor Ci (i=1, 2, 3) and a switch Si (i=1, 2, 3), in one embodiment. The inductor Li is coupled in series with a corresponding LED string 308_*i* (i=1, 2, 3). The diode Di is coupled in parallel with the serially connected LED string and the inductor Li. The capacitor Ci is coupled in parallel with a corresponding LED string 308_*i*. The switch Si is coupled between the DC/DC converter 302 and the inductor Li. Each buck switching regulator is controlled by a pulse modulation signal, e.g., a pulse-width modulation (PWM) signal, generated by a corresponding switching balance controller 704_*i* (i=1, 2, 3).

The LED driving circuit 700 also includes a DC/DC converter 302 for providing a regulated voltage, and a feedback selection circuit 312 for providing a feedback signal 301 to adjust the regulated voltage of the DC/DC converter, in order to satisfy a power need of an LED string having a maximum forward voltage.

During a first time period when the switch Si is turned on, an LED current flows through LED string 308_*i* to ground. The forward voltage of the LED string 308_*i* is proportional to a difference between the regulated voltage $V_{OUT}$ and a voltage drop across a corresponding switching regulator, in one embodiment. During this first time period, DC/DC converter 302 powers the LED string 308_*i* and charges the inductor Li simultaneously by the regulated voltage $V_{OUT}$. During a second time period when the switch Si is turned off, an LED current flows through the inductor Li, the LED string 308_*i*, and the diode Di. During this second time period, the inductor Li discharges to power the LED string 308_*i*.

Figure 8:
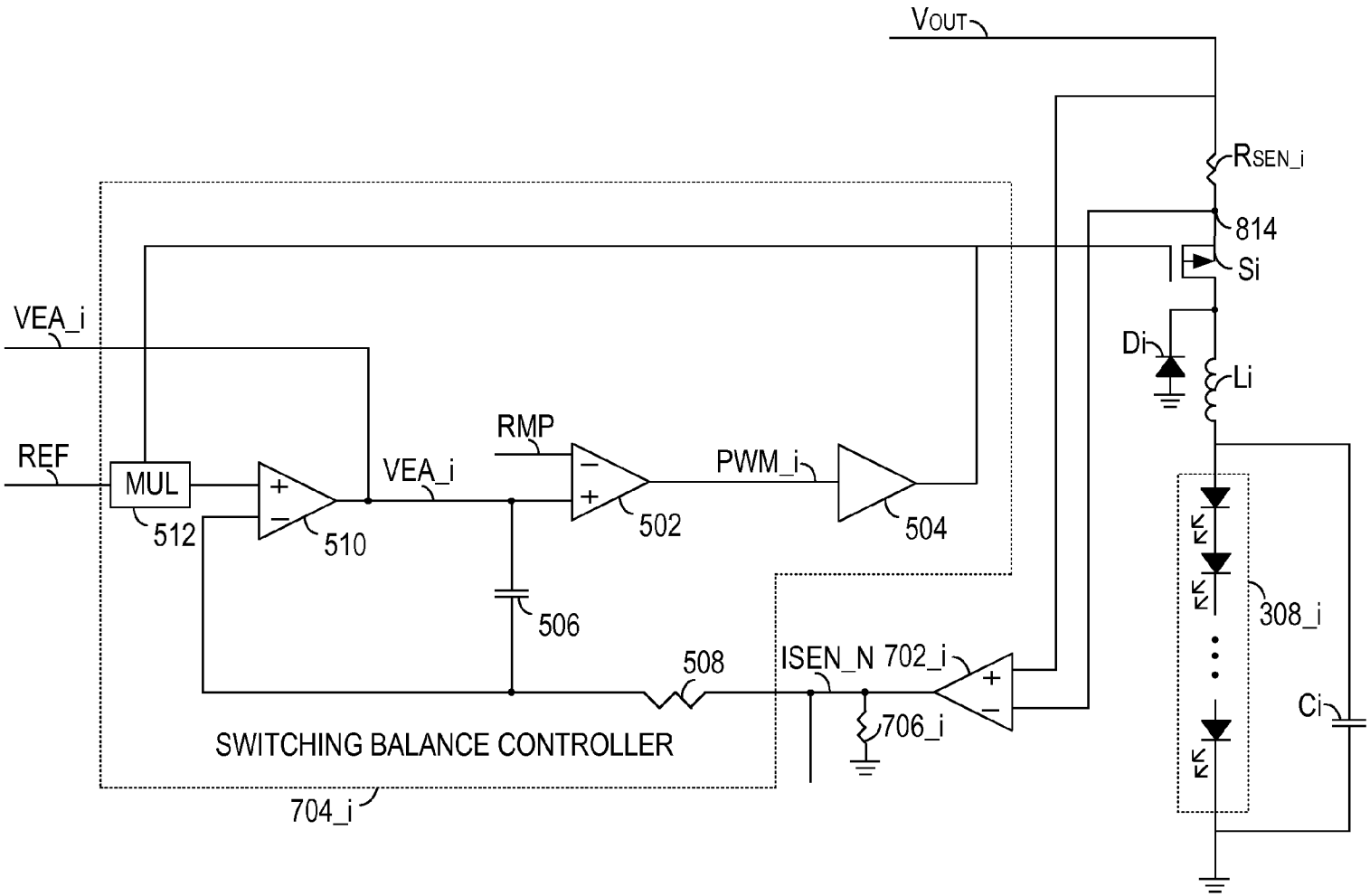
FIG. 8 shows an example of a switching balance controller shown in FIG. 7 and the connection between the switching balance controller and a corresponding LED string, in accordance with one embodiment of the present invention.

FIG. 8 illustrates an example of a switching balance controller 704_*i* (i=1, 2, 3) shown in FIG. 7 and the connection between the switching balance controller 704_*i* and a corresponding LED string 308_*i*. FIG. 8 is similar to FIG. 5 except that, for the LED driving circuit 700 shown in FIG. 7 with a common cathode connection, the differential amplifier 702_*i* detects the voltage drop across the current resistor $R_{SEN_i}$. Through the resistor 706_*i*, a monitoring signal ISEN_i indicating an LED current of the LED strings 308_*i* can be provided. In one embodiment, resistor 706_*i* has the same resistance as the current sensing resistor $R_{SEN_i}$.

Figure 9:
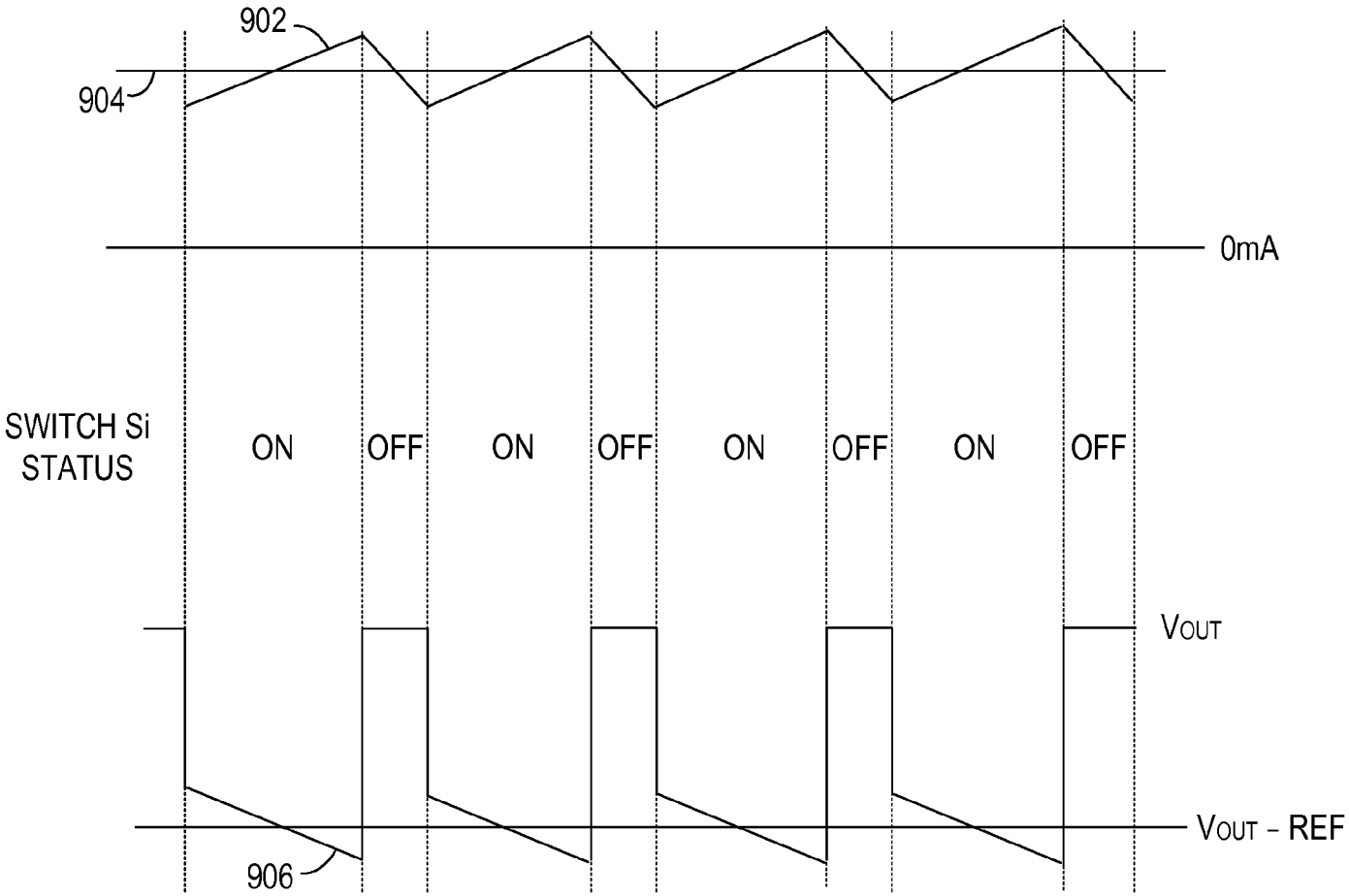
FIG. 9 illustrates the relationship among an LED current, an inductor current, and a voltage waveform at the current sensing resistor shown in FIG. 8, in accordance with one embodiment of the present invention.

FIG. 9 illustrates an example of relationship among an LED current 904 of the LED string 308_*i*, an inductor current 902 of inductor Li, and a voltage waveform 906 at node 814 between $R_{SEN_i}$ and switch Si. FIG. 9 is described in combination with FIG. 7 and FIG. 8.

During the time period when the switch Si is turned on, the DC/DC converter 302 powers the LED string 308_*i* and charges the inductor Li by the regulated voltage $V_{OUT}$. When the switch Si is turned on by PWM_i, the inductor current 902 flows through the LED string 308_*i* to ground. The inductor current 902 increases when the switch Si is on, and the voltage waveform 906 at node 814 decreases simultaneously.

During the time period when the switch Si is turned off, the inductor Li discharges and the LED string 308_*i* is powered by the inductor Li. When the switch Si is turned off by PWM_i, the inductor current 902 flows through the inductor Li, the LED string 308_*i*, and the diode Di. The inductor current 902 decreases when the switch Si is off. Since there is no current flowing through the current sensing resistor $R_{SEN_i}$, the voltage waveform 906 at node 814 rises to $V_{OUT}$.

In one embodiment, the capacitor Ci coupled in parallel with the LED string 308_*i* filters the inductor current 902 and yields a substantially constant LED current 904 whose level is an average level of the inductor current 902.

Accordingly, the LED current 904 of LED string 308_*i* can be adjusted towards the target current. The average voltage at node 814 when the switch Si is turned on is equal to the difference between $V_{OUT}$ and the voltage of the reference signal REF, in one embodiment.

Figure 10:
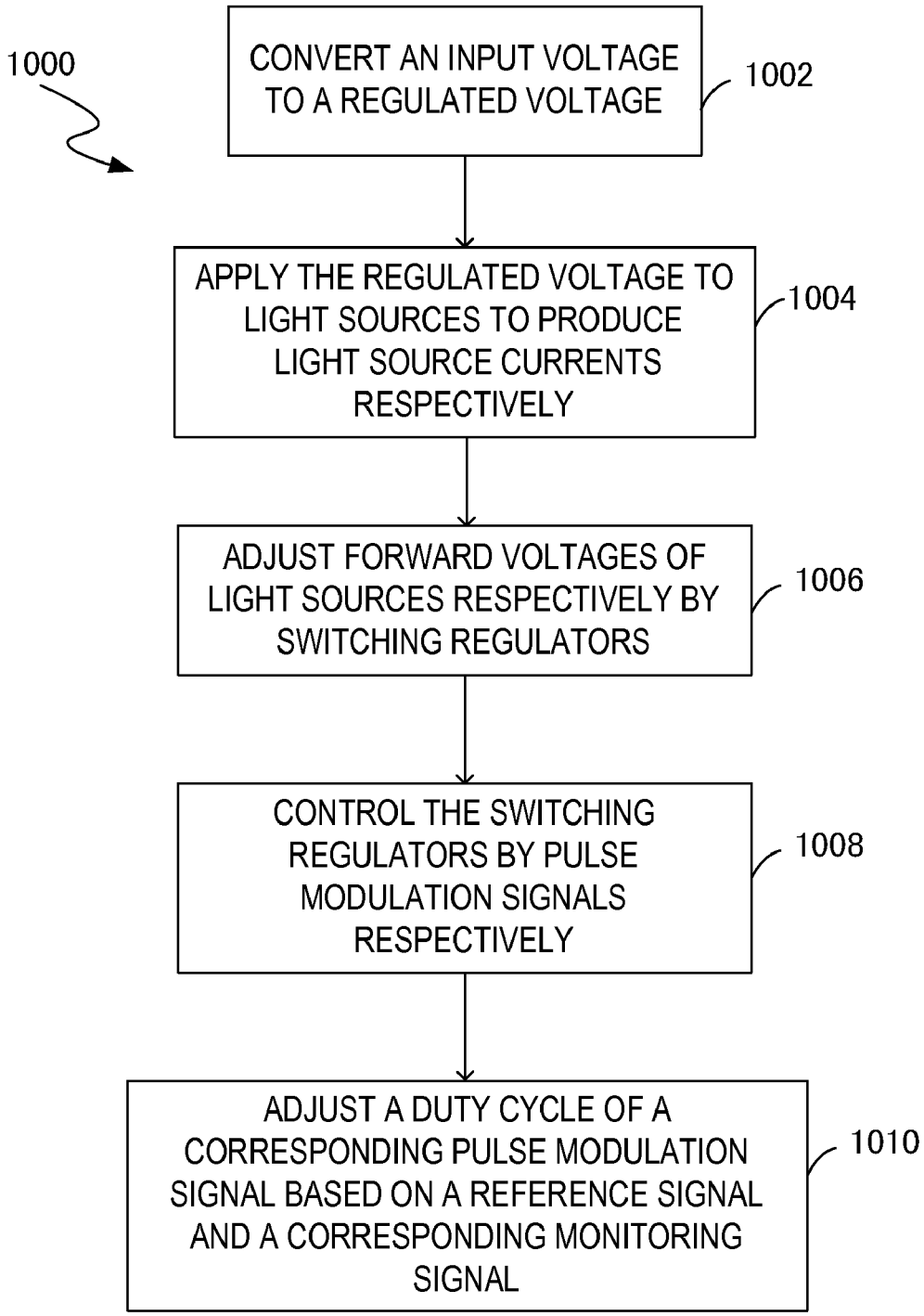
FIG. 10 shows a flowchart of a method for powering a plurality of light sources, in accordance with one embodiment of the present invention.

FIG. 10 illustrates a flowchart 1000 of a method for powering a plurality of LED light sources. Although specific steps are disclosed in FIG. 10, such steps are exemplary. That is, the present invention is well suited to performing various other steps or variations of the steps recited in FIG. 10. FIG. 10 is described in combination with FIG. 3 and FIG. 4.

In block 1002, an input voltage is converted to a regulated voltage by a power converter (e.g., a DC/DC converter 302).

In block 1004, the regulated voltage is applied to the plurality of LED light sources (e.g., the LED strings 308_1, 308_2, and 308_3) to produce a plurality of LED light source currents flowing through the LED light sources respectively.

In block 1006, a plurality of forward voltages of the plurality of LED light sources are adjusted by a plurality of switching regulators (e.g., a plurality of buck switching regulators 306_1, 306_2, and 306_3) respectively.

In block 1008, the plurality of switching regulators are controlled by a plurality of pulse modulation signals (e.g., PWM signals PWM_1, PWM_1, PWM_3) respectively. In one embodiment, a switch Si is controlled by a pulse modulation signal such that during a first time period when the switch Si is turned on, a corresponding light source is powered by the regulated voltage, and a corresponding inductor Li is charged by the regulated voltage. During a second time period when the switch Si is turned off, the inductor Li discharges, and the light source is powered by the inductor Li.

In block 1010, the duty cycle of a corresponding pulse modulation signal PWM_i is adjusted based on a reference signal REF and a corresponding monitoring signal ISEN_i. In one embodiment, the monitoring signal ISEN_i is generated by a current sensor 310_*i*, which indicates an LED light source current flowing through a corresponding LED light source.

Figure 11:
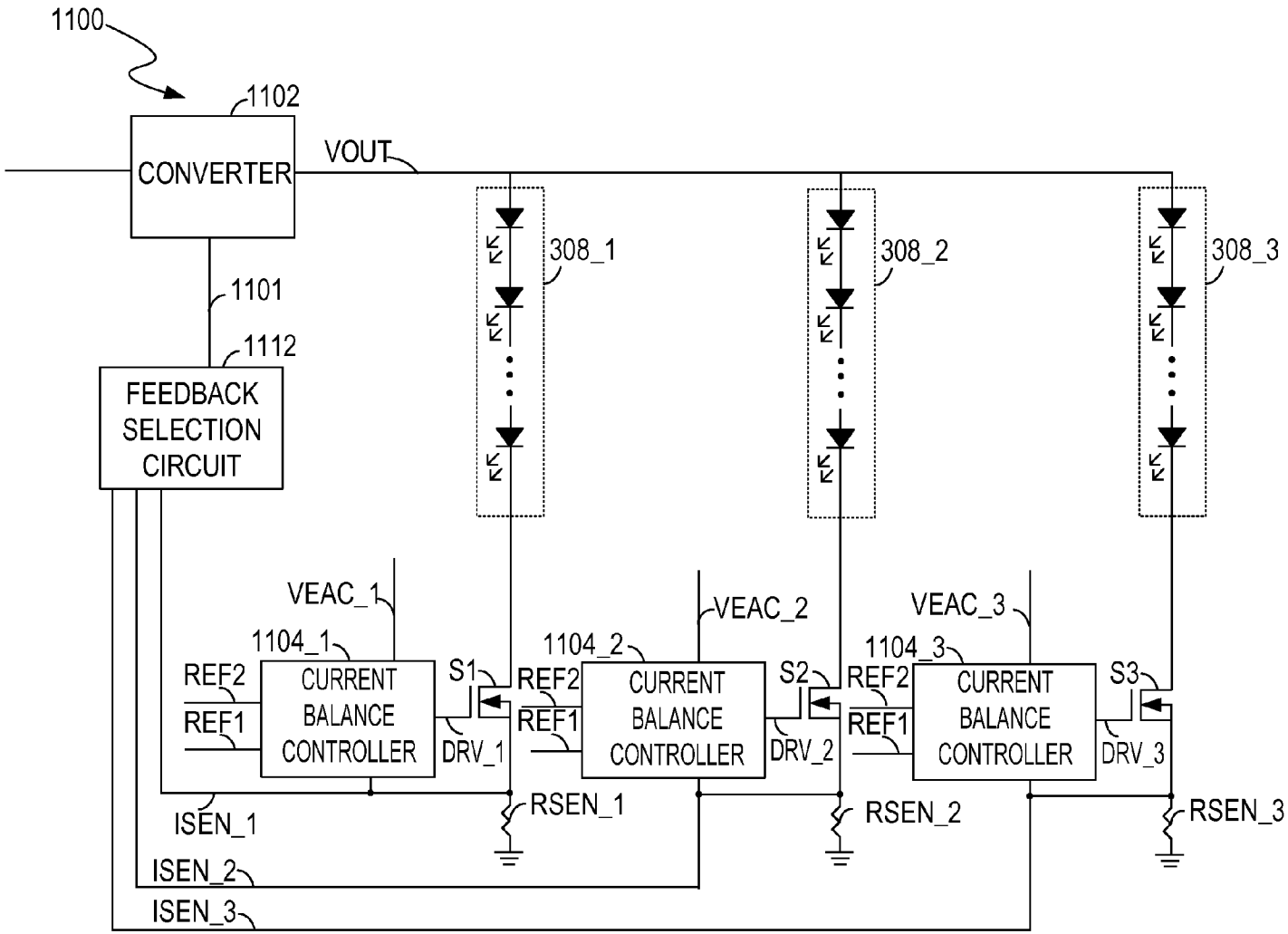
FIG. 11 shows a block diagram of an LED light source driving circuit, in accordance with one embodiment of the present invention.

FIG. 11 shows a block diagram of an LED driving circuit 1100, in accordance with one embodiment of the present invention. The LED driving circuit 1100 includes a power converter 1102 for receiving an input voltage and for providing a regulated voltage VOUT to a plurality of LED strings. The converter 1102 can be, but is not limited to, a DC/DC converter or an AC/DC converter. In the example of FIG. 11, there are three LED strings 308_1, 308_2 and 308_3 for illustrative purposes. However, other numbers of the LED strings can be included in the LED driving circuit 1100. The LED driving circuit 1100 also includes a plurality of switches S1, S2 and S3 (e.g., metal-oxide-semiconductor field-effect transistors) coupled to the LED strings 308_1, 308_2 and 308_3 respectively.

Moreover, the LED driving circuit 1100 includes a plurality of current balance controllers 1104_1, 1104_2 and 1104_3 coupled to the power converter 1102. The current balance controllers 1104_1, 1104_2 and 1104_3 can regulate the currents flowing through the LED strings 308_1, 308_2 and 308_3 within a predetermined range (e.g., below a predetermined current level) respectively and can balance the currents of the LED strings 308_1, 308_2 and 308_3 by controlling the switches S1, S2 and S3. More specifically, the current balance controllers 1104_1, 1104_2 and 1104_3 receive a first reference signal REF1 indicative of a target average level and receive a second reference signal REF2 indicative of a maximum transient level, and regulate an average current of each current through a corresponding LED string to the target average level and regulate a transient level of each current through a corresponding LED string within the maximum transient level.

A feedback selection circuit 1112 coupled between the converter 1102 and the current balance controllers 1104_1, 1104_2 and 1104_3 adjusts the output voltage of the converter 1102 based on the currents flowing through the LED strings 308_1, 308_2 and 308_3.

A plurality of current sensors (e.g., resistors $R_{SEN_1}$, $R_{SEN_2}$, and $R_{SEN_3}$ are coupled to the switches S1, S2 and S3 respectively for providing a plurality of monitoring signals ISEN_1, ISEN_2 and ISEN_3 which indicate the currents flowing through the LED strings 308_1, 308_2 and 308_3 respectively. In one embodiment, the monitoring signals ISEN_1, ISEN_2 and ISEN_3 further indicate the forward voltage drops across the corresponding LED strings respectively. More specifically, the corresponding forward voltage drop $V_{308_i}$ across the LED string 308_*i* (e.g., i=1, 2, 3) can be given by:

$$V_{308_i}=VOUT-V_{Si}-V_{ISEN_i}, \quad (3)$$

where $V_{Si}$, is the forward voltage drop across the switch Si, and $V_{ISEN_i}$ is the voltage of the monitoring signal ISEN_i.

The current balance controllers 1104_1, 1104_2 and 1104_3 generate a plurality of driving signals DRV_1, DRV_2 and DRV_3 (e.g., pulse signals) to control the switches S1, S2 and S3 coupled in series with the LED strings 308_1, 308_2 and 308_3 respectively. The duty cycle of the driving signal DRV_i (e.g., i=1, 2, 3) is determined based on a corresponding monitoring signal ISEN_i and the first reference signal REF1. More specifically, in one embodiment, the duty cycle of the driving signal DRV_i is determined according to a difference between an average of the corresponding monitoring signal ISEN_i and the first reference signal REF1. Alternatively, the duty cycle of the driving signal DRV_i can be determined according to an average of the difference between the corresponding monitoring signal ISEN_i and the first reference signal REF1. The amplitude of the driving signal DRV_i is determined according to a difference between the corresponding monitoring signal ISEN_i and the second reference signal REF2.

In operation, the current balance controller 1104_*i* receives the first reference signal REF1 indicating a target average current $I_{REF1}$, and receives a corresponding monitoring signal ISEN_i from the current sensor $R_{SEN_i}$. The current balance controller 1104_*i* generates an error signal VEAC_i based on the first reference signal REF1 and the monitoring signal ISEN_i. More specifically, in one embodiment, the current balance controller 1104_*i* generates the error signal VEAC_i indicating the difference between the reference signal REF1 and the average of the monitoring signal ISEN_i. Alternatively, the current balance controller 1104_*i* can generate the error signal VEAC_i indicating an average of the difference between the reference signal REF1 and the monitoring signal ISEN_i. In one embodiment, the error signal VEAC_i further indicates the amount of the forward voltage required by the corresponding LED string 308_*i* to produce an LED current of which the average level is substantially the same as the target average current $I_{REF1}$.

Based on the error signal VEAC_i, the current balance controller 1104_*i* generates a corresponding driving signal DRV_i to regulate the current flowing through the LED string 308_*i*. The driving signal DRV_i can be a pulse modulated signal, e.g., a pulse-width modulated signal. Thus, the switch Si can be turned on and off alternately and the current flowing through the LED string 308_*i* can be discontinuous. The current flowing through the LED string 308_*i* is controlled to have an average level $I_{AVG}$ substantially equal to the target average current $I_{REF1}$. In one embodiment, the error signal VEAC_i is proportional to the difference between the reference signal REF1 and the average of the monitoring signal ISEN_i, and the duty cycle D of the driving signal DRV_i is proportional to the error signal VEAC_i. Hence, if the monitoring signal ISEN_i is less than the reference signal REF1 such that the level of the error signal VEAC_i is so high that the duty cycle D is equal to 100%, the switch Si remains on and the current flowing through the LED string 308_*i* is continuous.

Furthermore, the current balance controller 1104_*i* receives the second reference signal REF2 indicating a maximum transient current $I_{MAX}$ flowing through the LED string 308_*i*. The current balance controllers 1104_*i* controls the transient current $I_{TRAN}$ flowing through the LED string 308_*i* within the maximum transient current $I_{MAX}$, thereby preventing the LEDs from undergoing over-current conditions.

Figure 12A:
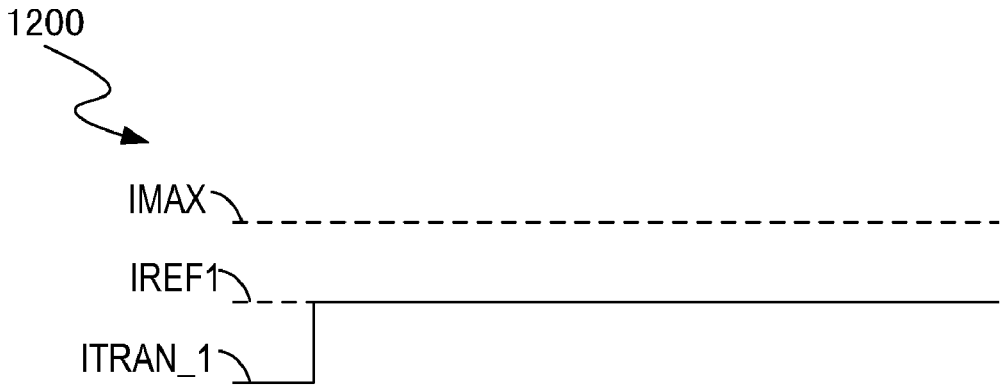
FIG. 12A-FIG. 12C illustrate examples of waveforms associated with the LED light source driving circuit shown in FIG. 11, in accordance with one embodiment of the present invention.
Figure 12B:
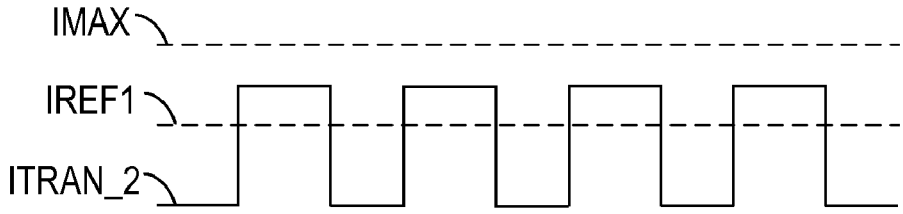
Figure 12C:
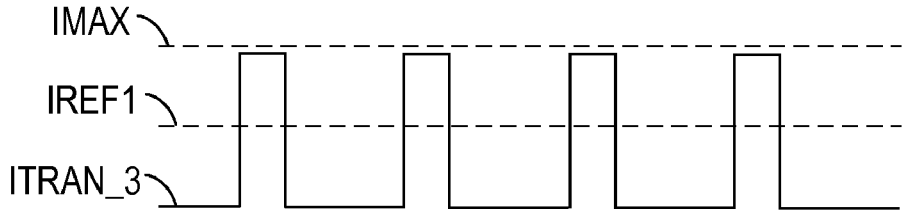

FIG. 12A-FIG. 12C illustrate examples of waveforms associated with the converter 1100. FIG. 12A shows the transient current $I_{TRAN_1}$ flowing through the LED string 308_1. FIG. 12B shows the transient current $I_{TRAN_2}$ flowing through the LED string 308_2. FIG. 12C shows the transient current $I_{TRAN_3}$ flowing through the LED string 308_3.

If the error signal VEAC_1 indicating the difference between the reference voltage REF1 and the average of the monitoring signal ISEN1 is large enough, the duty cycle of the driving signal DRV_1 is 100%, and the transient current $I_{TRAN_1}$ flowing through the LED string 308_1 is continuous. Thus, the transient current flowing through the LED string 308_1 is equal to the average current flowing through the LED string 308_1. For the LED string 308_2, assume that the error signal VEAC_2 is less than the error signal VEAC_1 and the duty cycle of the monitoring signal ISEN_2 is less than the duty cycle of the monitoring signal ISEN_1. Under the regulation of the current balance controller 1104_2, the transient current $I_{TRAN_2}$ flowing through the LED sting 308_2 is discontinuous and greater than the target average current $I_{REF1}$. For the LED string 308_3, assume that the error signal VEAC_3 is the least among the error signals VEAC_1, VEAC_2 and VEAC_3. Thus, the duty cycle of the monitoring signal ISEN_3 is the least among the monitoring signals ISEN_1, ISEN_2 and ISEN_3. Under the regulation of the current balance controller 1104_3, the transient current $I_{TRAN_3}$ flowing through the LED string 308_3 is the greatest among the transient currents $I_{TRAN_1}$, $I_{TRAN_2}$ and $I_{TRAN_3}$ but still less than the maximum transient current $I_{MAX}$. Consequently, under the regulation of the current balance controllers 1104_1, 1104_2 and 1104_3, all the average currents flowing through the LED strings 308_1, 308_2 and 308_3 are substantially equal to the target average current $I_{REF1}$. The regulation by the current balance controller 1104_*i* is further discussed in relation to FIG. 13.

Referring back to FIG. 11, in one embodiment, the feedback selection circuit 1112 receives the error signals VEAC_1, VEAC_2 and VEAC_3 and determines which LED string has a maximum forward voltage. Alternatively, the feedback selection circuit 1112 can determine which LED string has a maximum forward voltage according to the monitoring signals ISEN_i from the current sensor $R_{SEN_i}$. The term "maximum forward voltage" used in the present disclosure indicates the greatest forward voltage among the forward voltages of LED strings 308_1, 308_2, and 308_3, in one embodiment. The feedback selection circuit 1112 generates a feedback signal 1101 indicating the current of the LED string having the maximum forward voltage. Consequently, the converter 1102 adjusts the regulated voltage VOUT according to the feedback signal 1101 to satisfy a power need of the LED string having the maximum forward voltage, in one embodiment. Accordingly, the power need of LED strings having less forward voltages can also be satisfied.

Figure 13:
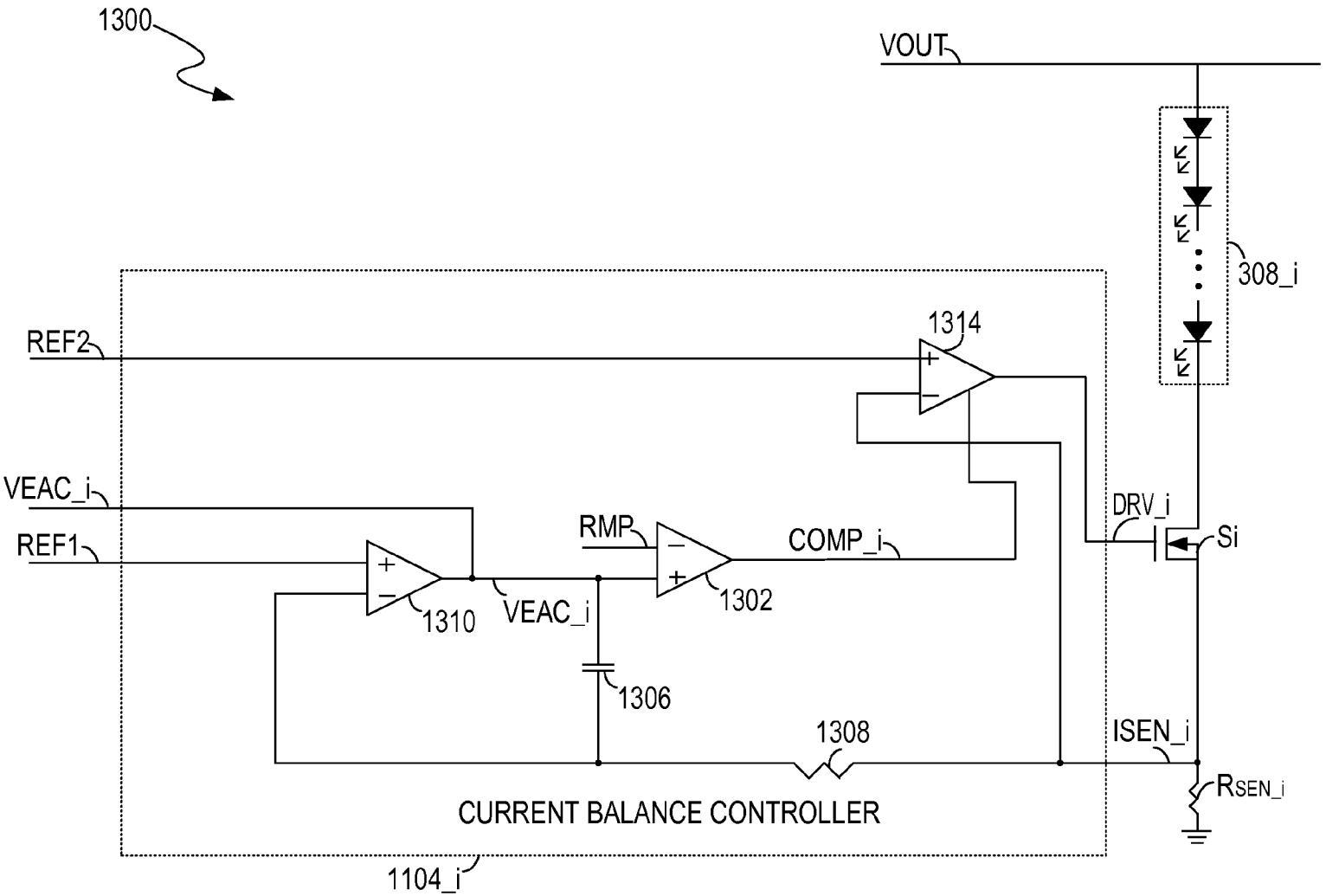
FIG. 13 illustrates an example of a current balance controller shown in FIG. 11 and the connection between the current balance controller and a corresponding LED light source, in accordance with one embodiment of the present invention.

FIG. 13 illustrates an example of the structure of a current balance controller 1104_*i* shown in FIG. 11 and the connection between the current balance controller 1104_*i* and a corresponding LED string 308_*i*. In one embodiment, the controller 1104_*i* includes a first reference pin for receiving the first reference signal REF1 indicative of the target average level $I_{REF1}$, a second reference pin for receiving a second reference signal REF2 indicative of a maximum transient level $I_{MAX}$. The controller 1104_*i* regulates an average of the current flowing through the LED string 308_*i* to the target average level $I_{REF1}$, and a transient level of the current flowing through the LED string 308_*i* within the maximum transient level $I_{MAX}$. The controller 1104_*i* further includes a sensing pin for receiving a monitoring signal indicative of the current flowing through the LED string 308_*i*. The controller 1104_*i* compares an average of the monitoring signal ISEN_i to the first reference signal REF1 and compares the monitoring signal ISEN_i to the second reference signal REF2. As a result, the duty cycle of the current flowing through the LED string 308_*i* is determined according to the first reference signal REF1. The amplitude of the current flowing through the LED string 308_*i* is determined according to the second reference signal REF2.

In the example of FIG. 13, the current balance controller 1104_*i* includes an integrator for generating the error signal VEAC_i, a comparator 1302 for comparing the error signal VEAC_i with a ramp signal RMP to generate an enable signal COMP_i, and an error amplifier 1314 for generating a driving signal DRV_i to drive the switch Si. The integrator includes a resistor 1308 coupled to the current sensing resistor $R_{SEN_i}$, an error amplifier 1310, a capacitor 1306 with one end coupled between the error amplifier 1310 and the comparator 1302 and the other end coupled to the resistor 1308. The error amplifier 1310 receives the reference signal REF1 and the average of the monitoring signal ISEN_i, and generates the error signal VEAC_i based upon a difference between the reference signal REF1 and the average of the monitoring signal ISEN_i.

The comparator 1302 compares the error signal VEAC_i to the ramp signal RMP to generate the enable signal COMP_i. In the example of FIG. 13, the signal COMP_i has a constant level if the peak level of the ramp signal is less than the error signal VEAC_i. Otherwise, the signal COMP_i includes a plurality of pulses. The signal COMP_i is used to enable and disable the error amplifier 1314. By way of example, when the error signal VEAC_i is greater than the ramp signal RMP, the signal COMP_i has a logic high to enable the error amplifier 1314, in one embodiment. When the error signal VEAC_i is less than the ramp signal RMP, the signal COMP_i has a logic low to disable the error amplifier 1314, in one embodiment.

The error amplifier 1314 generates a corresponding driving signal DRV_i by comparing the monitoring signal ISEN_i to the second reference REF2 when the error amplifier 1314 is enabled by the signal COMP_i. More specifically, if the error amplifier 1314 is disabled, the signal DRV_i turns off the switch Si, and no current flows through the LED string 308_*i*. If the error amplifier 1314 is enabled, the signal DRV_i is controlled by the difference between the reference signal REF2 and the monitoring signal ISEN_i. In other words, the duty cycle of the signal DRV_i is determined by the signal COMP_i, e.g., the comparison between the error signal VEAC_i and the ramp signal RMP. The amplitude of the signal DRV_i is determined by the difference between the reference signal REF2 and the monitoring signal ISEN_i. If the amplitude of the signal DRV_i is relatively high, the corresponding switch Si is fully on when it is turned on, and if the amplitude of the signal DRV_i is relatively low, the corresponding switch Si is controlled linearly when it is turned on, in one embodiment. As a result, the error amplifier 1314 controls the average current of the LED string 308_*i* substantially equal to the target average current $I_{AVG}$ and also controls the transient current $I_{TRAN}$ flowing through the LED string 308_*i* within the maximum transient current $I_{MAX}$. For example, if the transient current $I_{TRAN}$ flowing through the LED string 308_*i* increases, the amplitude of the signal DRV_i decreases, and thus the transient current $I_{TRAN}$ flowing through the LED string 308_*i* decreases. Therefore, the error signal VEAC_i indicating a difference between the average of the monitoring signal ISEN_i and the reference signal REF1 increases. Accordingly, the signal COMP_i indicating the duty cycle of the DRV_i signal increases. As such, by decreasing the amplitude of the signal DRV_i and increasing the duty cycle of the signal DRV_i, the average current of the LED string 308_*i* maintains substantially equal to the target average current $I_{AVG}$, and the transient current of the LED string 308_*i* does not exceed the maximum transient current $I_{MAX}$.

Advantageously, the power consumption of the switches is reduced. Thus, the heat problem caused by the switches is avoided or reduced, and the power efficiency of the LED driving circuit is improved. More specifically, for a switch coupled in series with the LED string having a continuous current, since the amplitude of the corresponding driving signal DRV_i is relatively high, the switch can be fully on, thereby having less power consumption. For a switch connected with the LED string having a discontinuous current, though the transient current flowing through the switch is increased, the conductance time of the switch and the forward voltage drop across the switch are decreased. Thus, the power consumption of the switch coupled with the LED string having a discontinuous current is also decreased.

Figure 14B:
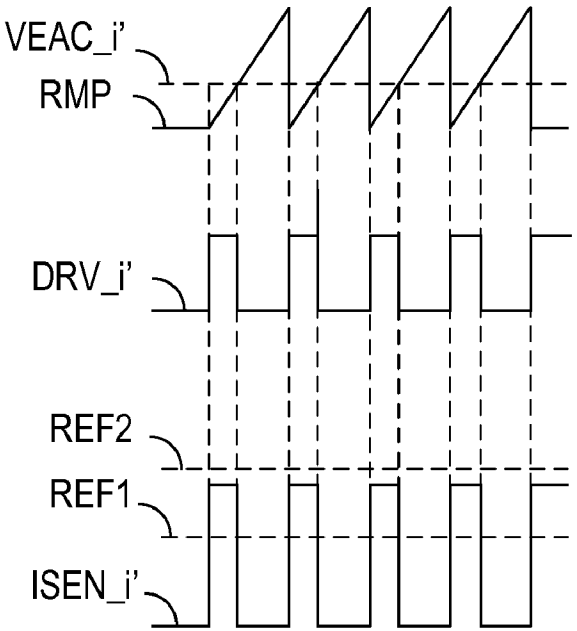
FIG. 14A-FIG. 14B illustrate examples of the waveforms associated with the current balance controller shown in FIG. 13, in accordance with one embodiment of the present invention.
Figure 14A:
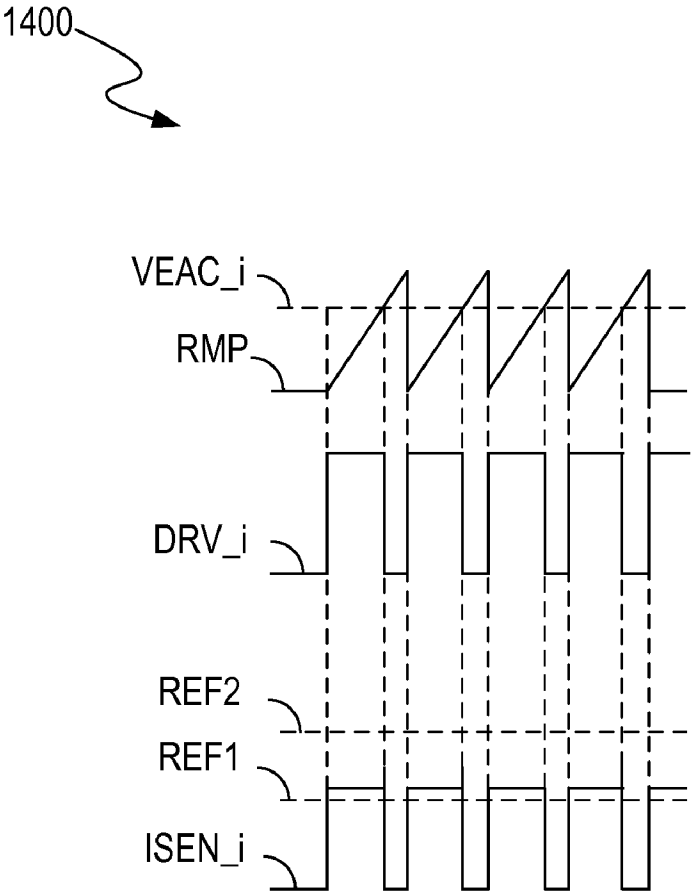

FIG. 14A-FIG. 14B illustrate examples of the waveforms 1400 associated with the circuit 1300. FIG. 14A-FIG. 14B are described in combination with FIG. 13. FIG. 14A shows waveforms of the error signal VEAC_i, the ramp signal RMP, the driving signal DRV_i, the reference voltages REF1 and REF2, and the monitoring signal ISEN_i. The transient level of the monitoring signal ISEN_i is lower than the reference voltage REF2, and the average level of the monitoring signal ISEN_i is substantially equal to the reference voltage REF1.

FIG. 14B shows waveforms of the error signal VEAC_i', the ramp signal RMP', the driving signal DRV_i', the reference voltages REF1 and REF2, and the monitoring signal ISEN_i'. In the example of FIG. 14B, the monitoring signal ISEN_i' is greater than the monitoring signal ISEN_i in the example of FIG. 14A, and thus the amplitude of the driving signal DRV_i' is less than the amplitude of the driving signal DRV_i. Moreover, the error signal VEAC_i' is less than the error signal VEAC_i accordingly, and thus the duty cycle of the driving signal DRV_i' is less than the duty cycle of the driving signal DRV_i. The transient level of the monitoring signal ISEN_i' is lower than the reference voltage REF2, and the average level of the monitoring signal ISEN_i' is also substantially equal to the reference voltage REF1.

Figure 15:
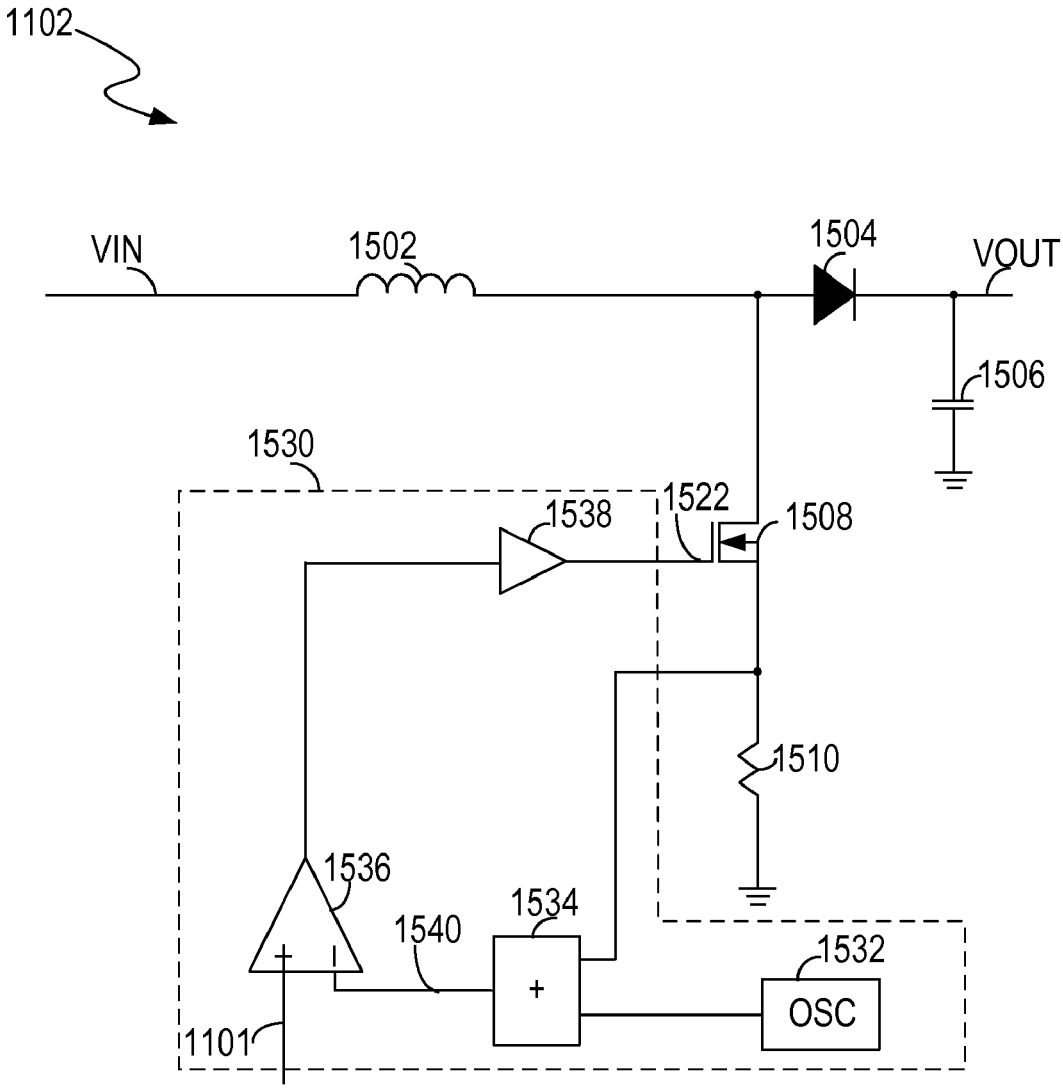
FIG. 15 illustrates an example of a converter shown in FIG. 11, in accordance with one embodiment of the present invention.

FIG. 15 illustrates an example of the structure of a converter 1102 shown in FIG. 11. In the example of FIG. 15, the converter 1102 is a DC/DC converter including an inductor 1502, a capacitor 1506, a diode 1504, a power switch 1508 for controlling the output voltage VOUT, a controller 1530 for generating a control signal 1522 to control the power switch 1508, and a sensor 1510 for sensing the current flowing through the power switch 1508. The power switch 1508 can be, but not limited to, a metal-oxide-semiconductor filed-effect transistor. In one embodiment, the sensor 1510 is a resistor. In one embodiment, the control signal 1522 is a pulse-width modulation (PWM) signal.

In operation, when the power switch 1508 is turned on, a current flowing through the inductor 1502, the power switch 1508 and the resistor 1510 charges the inductor 1502. When the power switch 1508 is turned off, a current flowing through the inductor 1502 and the diode 1504 charges the capacitor 1506. As such, the output voltage VOUT is regulated.

The controller 1530 includes an oscillator 1532, an accumulator 1534, a comparator 1536, and a buffer 1538. In operation, the accumulator 1534 adds a sensing signal from the sensor 1510 to a ramp signal generated by the oscillator 1532 to output an accumulated signal 1540. The comparator 1536 compares the accumulated signal 1540 with the feedback signal 1101 indicative of the current of the LED string having the maximum forward voltage drop. The output of the comparator 1536 is provided to the power switch 1508 via the buffer 1538. As such, the driving signal 1522 can regulate the output voltage VOUT to satisfy the power need of the LED strings 308_1, 308_2 and 308_3.

Figure 16:
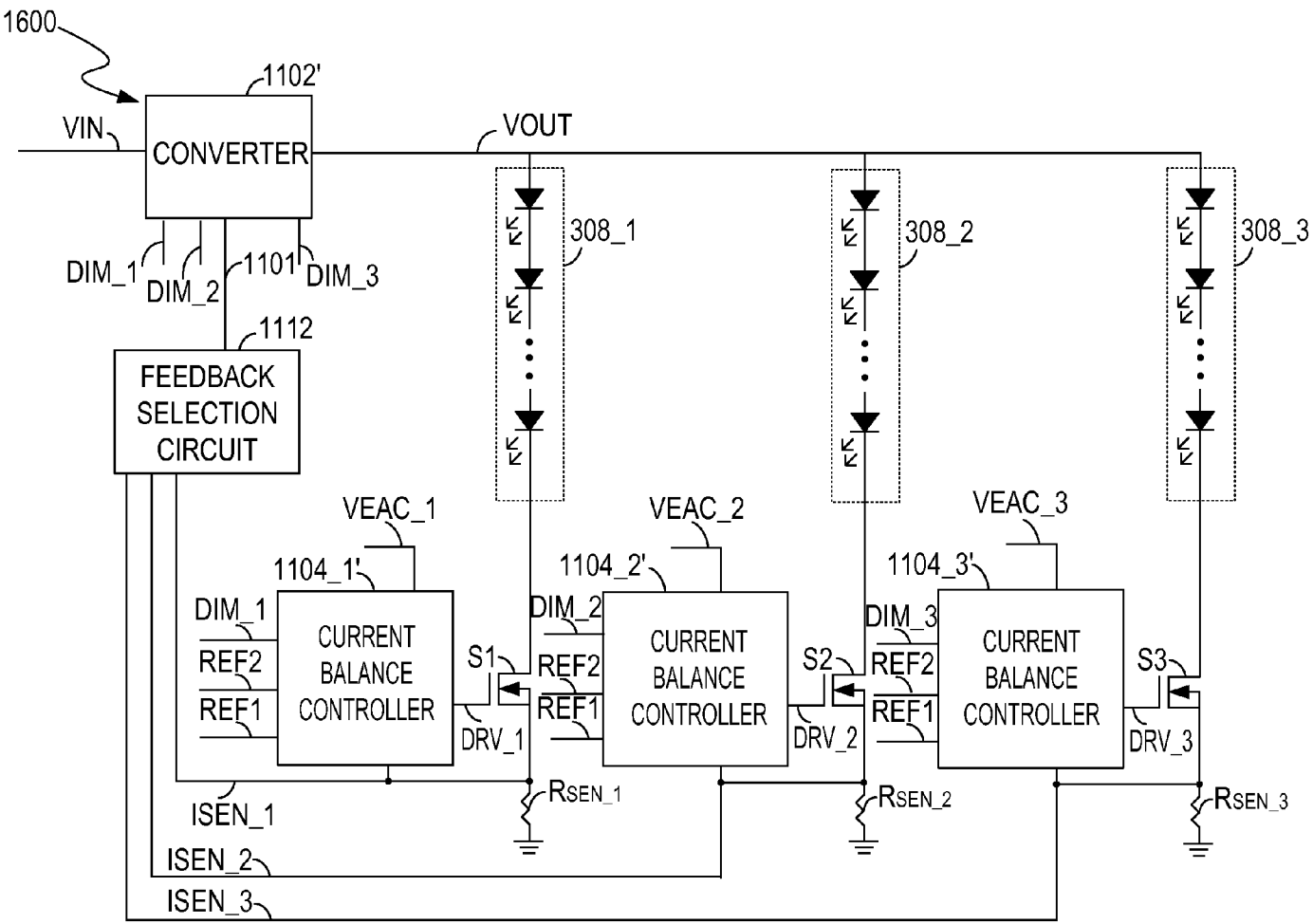
FIG. 16 shows a block diagram of an LED light source driving circuit, in accordance with another embodiment of the present invention.

FIG. 16 shows a block diagram of an LED driving circuit 1600, in accordance with another embodiment of the present invention. Elements labeled the same as in FIG. 11 have similar functions. The current balance controller 1104_*i*' further receives a corresponding dimming signal DIM_i. The dimming signal DIM_i can be a pulse-width modulation signal. The brightness of the LED string 308_*i* is controlled by the reference signals REF1 and REF2 and the dimming signal DIM_i. More specifically, when the signal DIM_i is set to a first level, e.g., logic high, the current balance controller 1104_*i*' is enabled, and the driving signal DRV_i regulates the current flowing through the LED string 308_*i* via the switch Si according to the reference signals REF1 and REF2. When the signal DIM_i is set to a second level, e.g., logic low, the current balance controller 1104_*i*' is disabled, and thus the switch Si remains off and no current flows through the LED string 308_*i*. In one embodiment, the frequency of the dimming signal DIM_i is lower than the switching frequency of the switch Si.

Furthermore, the circuit 1600 can synchronize the driving signal DRV_i with the dimming signal DIM_i. For example, when the dimming signal DIM_i has the rising edge to enable the corresponding current balance controller 1104_*i*', the driving signal DRV_i also has the rising edge to turn on the corresponding switch Si; when the dimming signal DIM_i has the falling edge to disable the corresponding current balance controller 1104_*i*', the driving signal DRV_i also has the falling edge to turn off the corresponding switch Si.

Moreover, in one embodiment, the dimming signal DIM_i controls the operation of the converter 1102'. If any of the dimming signals DIM_1-DIM_3 is in the first level, the converter 1102' regulates the output voltage VOUT according to the feedback signal 1101. If all the dimming signals DIM_i are in the second level, the converter 1102' maintains the output voltage VOUT and does not regulate VOUT according to the feedback signal 1101.

Figure 17:
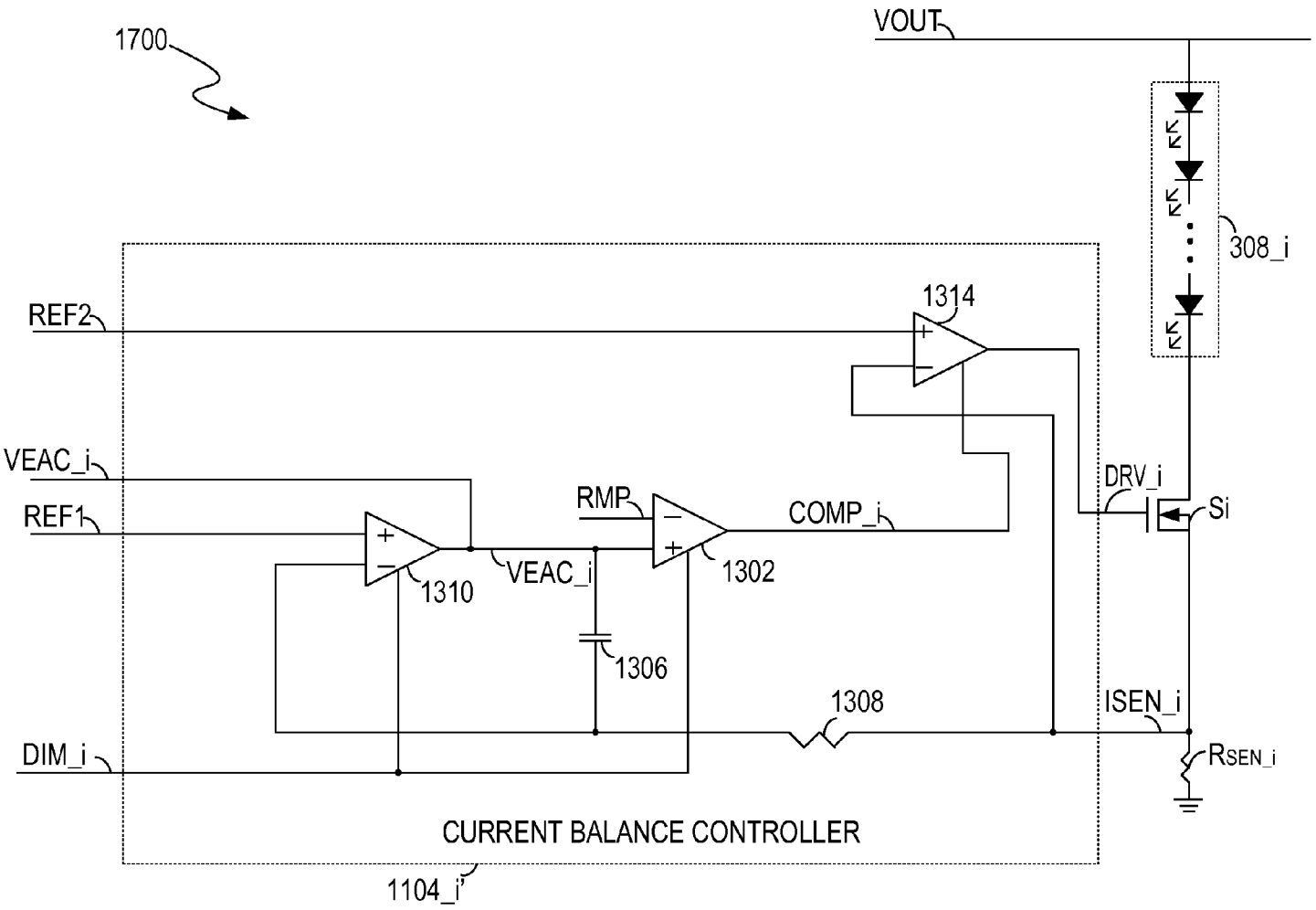
FIG. 17 illustrates an example of a current balance controller shown in FIG. 16, and the connection between the current balance controller and a corresponding LED light source, in accordance with another embodiment of the present invention.

FIG. 17 illustrates an example of the structure of a current balance controller 1104_*i'* shown in FIG. 16 and the connection between the current balance controller 1104_*i'* and a corresponding LED string 308_*i*. FIG. 17 is described in combination with FIG. 13 and FIG. 16. In the example of FIG. 17, the current balance controller 1104_*i*' further includes a dimming control pin for receiving the dimming signal DIM_i. The current through the LED string 308_*i* is determined according to the first reference signal REF1 and the second reference signal REF2 if the dimming signal DIM_i has a first level, and the current through the LED string 308_*i* is cut off if the dimming signal DIM_i has a second level. More specifically, the dimming signal DIM_i enables or disables the error amplifier 1310 and the comparator 1302. When the dimming signal DIM_i is in the second level, the error amplifier 1310 and the comparator 1302 are disabled, and no current flows through the LED string 308_*i*. When the signal DIM_i is in the first level, the error amplifier 1310 and the comparator 1302 are enabled. In other words, the error amplifier 1310 compares the reference signal REF1 with the average of the monitoring signal ISEN_i, the comparator 1302 compares the ramp signal RMP with the error signal VEAC_i, and the driving signal DRV_i regulates the current flowing through the corresponding LED string 308_*i* via the switch Si. Moreover, the dimming signal DIM_i can control the ramp signal RMP to synchronize the driving signal DRV_i with the dimming signal DIM_i. The synchronization is further discussed in relation to FIG. 18.

Figure 18:
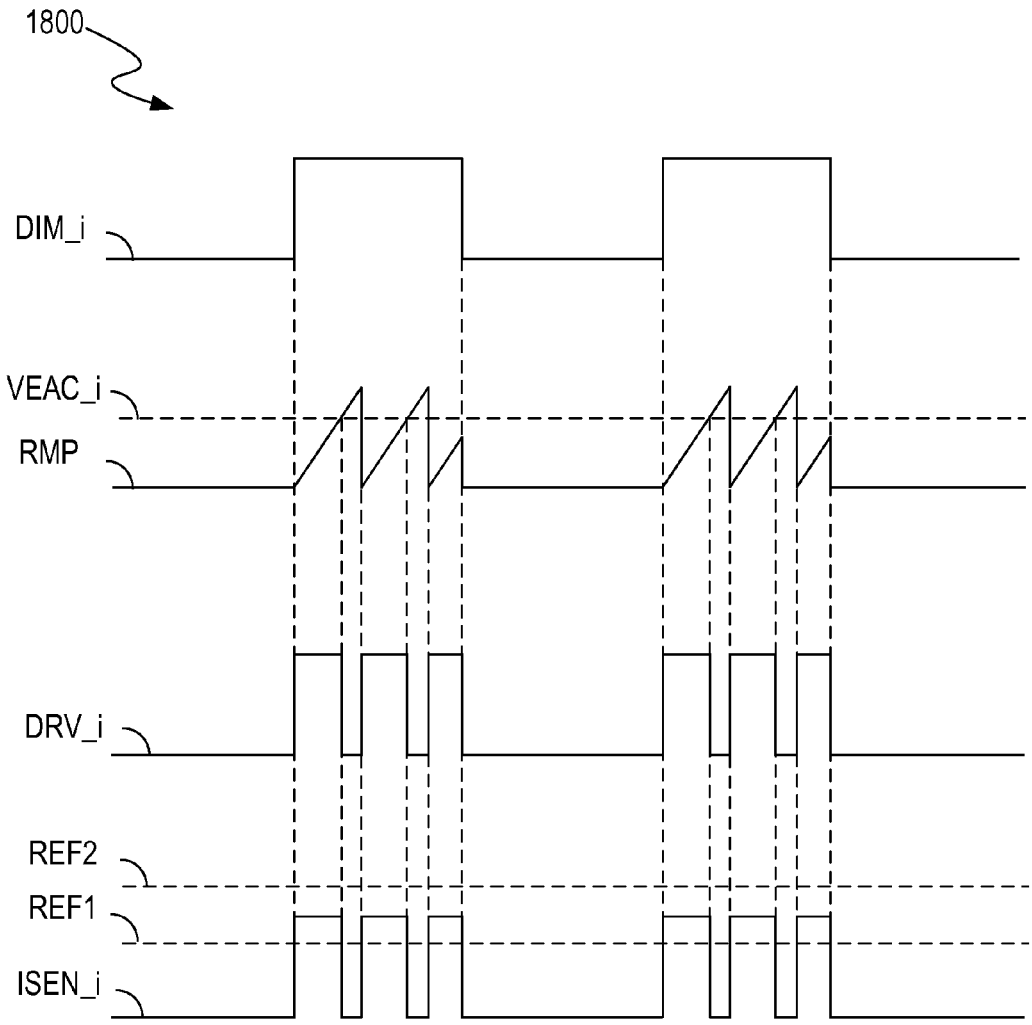
FIG. 18 illustrates an example of the waveforms associated with the current balance controller shown in FIG. 17, in accordance with another embodiment of the present invention.

FIG. 18 illustrates an example of the waveforms 1800 associated with the circuit 1700. FIG. 18 is described in combination with FIG. 17. In the example of FIG. 18, the dimming signal DIM_i is a pulse signal. Once the dimming signal DIM_i switches from the second state to the first state, e.g., from logic low to logic high, the ramp signal RMP starts increasing. When the dimming signal DIM_i is in the first state, the corresponding current balance controller 1104_*i*' can switch the switch Si on and off alternately according to the driving signal DRV_i. The monitoring signal ISEN_i indicates the current through the LED string 308_*i*. The error signal VEAC_i indicates the difference between the reference signal REF1 and the average of the monitoring signal ISEN_i. The transient level of the monitoring signal ISEN_i is lower than the reference voltage REF2, and the average level of the monitoring signal ISEN_i during the time period when the dimming signal DIM_i is logic high is substantially equal to the reference voltage REF1.

Moreover, once the dimming signal DIM_i switches from the first level to the second level, e.g., from logic high to logic low, the ramp signal RMP drops to the valley level. Accordingly, the driving signal DRV_i turns off the switch Si, and thus no current flows through the LED string 308_*i*. As such, the circuit 1700 can synchronize the ramp signal RMP with the dimming signal DIM_i, thereby synchronizing driving signal DRV_i with the dimming signal DIM_i.

Figure 19:
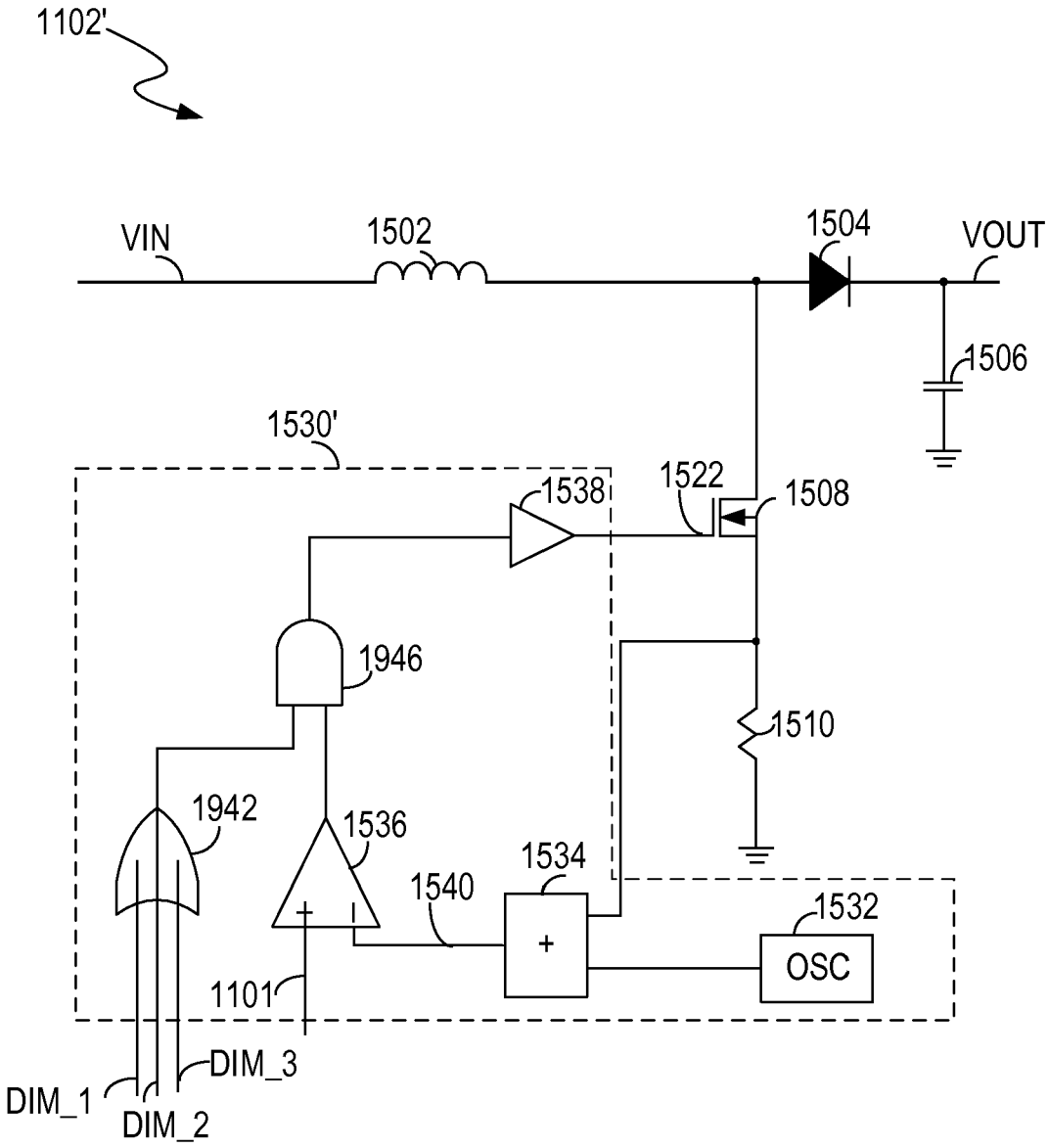
FIG. 19 illustrates an example of a converter shown in FIG. 16, in accordance with another embodiment of the present invention.

FIG. 19 illustrates an example of the structure of a converter 1102' shown in FIG. 16. Compared to the converter 1102 in the circuit 1100, the converter 1102' in the circuit 1600 further includes an OR gate 1942 and an AND gate 1946. The OR gate 1942 receives the dimming signals DIM_1-DIM_3. By employing the OR gate 1942 and the AND gate 1946, the converter 1102' regulates the output voltage VOUT according the feedback signal 1101 when any dimming signal DIM_i is in the first level, and disables the controller 1530' and maintains the output voltage VOUT if all the dimming signals DIM_1-DIM_3 are in the second level, in one embodiment.

Figure 20:
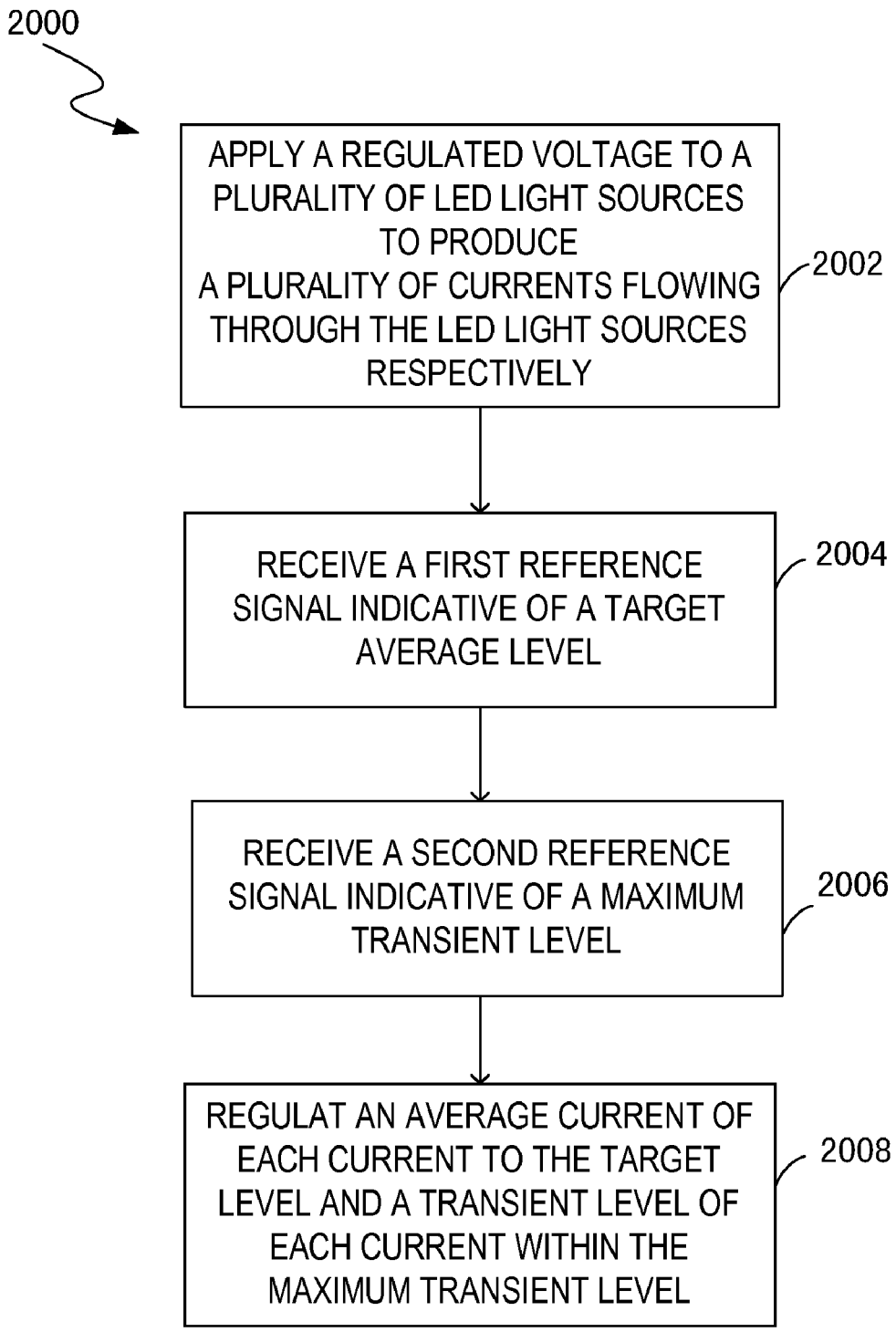
FIG. 20 illustrates a flowchart of a method for powering a plurality of LED light sources, in accordance with one embodiment of the present invention.

FIG. 20 illustrates a flowchart 2000 of a method for powering a plurality of LED light sources. Although specific steps are disclosed in FIG. 20, such steps are examples. That is, the present invention is well suited to performing various other steps or variations of the steps recited in FIG. 20. FIG. 20 is described in combination with FIG. 16.

In block 2002, an input voltage VIN is converted to a regulated voltage VOUT by a power converter, e.g., a DC/DC converter 1102', and the regulated voltage VOUT is applied to the plurality of LED light sources, e.g., the LED strings 308_1, 308_2, and 308_3, to produce a plurality of currents flowing through the LED light sources respectively.

In block 2004, a first reference signal REF1 indicative of a target average level is received.

In block 2006, a second reference signal REF2 indicative of a maximum transient level is received.

In block 2008, an average current of each of the currents flowing through the LED light sources is regulated to the target average level, and a transient level of each of the currents flowing through the LED light source is regulated within the maximum transient level. More specifically, a plurality of pulse signals DRV_i are generated to regulate the currents flowing through the LED strings 308_1, 308_2 and 308_3 respectively. The duty cycles of the pulse signals DRV_i are determined according to the first reference signal REF1. The amplitudes of the pulse signals DRV_i are determined according to the second reference signal REF2. More specifically, the duty cycle of the pulse signal DRV_i is determined according to the comparison between an error signal VEAC_i and a ramp signal RMP. The error signal VEAC_i is determined by the difference between an average of the monitoring signal ISEN_i and the first reference signal REF1, in one embodiment. The amplitude of the pulse signal DRV_i is determined by the difference between the second reference signal REF2 and the monitoring signal ISEN_i.

In one embodiment, the brightness of the LED string 308_*i* is further controlled by a dimming signal DIM_i. For example, when the dimming signal DIM_i is set to a first level, e.g., logic high, the current flowing through the LED string 308_*i* is regulated according to the reference signals REF1 and REF2, and when the dimming signal DIM_i is set to a second level, e.g., logic low, the current flowing through the corresponding LED string 308_*i* is disabled.

While the foregoing description and drawings represent embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. A driving circuit for powering a plurality of light-emitting diode (LED) light sources, said driving circuit comprising:

a power converter for receiving an input voltage and for providing a regulated voltage to said LED light sources; and a plurality of current balance controllers coupled to said power converter and for controlling a plurality of currents through said LED light sources respectively, said current balance controllers receiving a first reference signal indicative of a target average level and receiving a second reference signal indicative of a maximum transient level, and regulating an average current of each of said currents to said target average level and regulating a transient level of each of said currents within said maximum transient level.

2. The driving circuit of claim 1, wherein said current balance controllers regulate said currents according to said first reference signal and said second reference signal if a dimming signal has a first level, and wherein said current balance controllers are disabled if said dimming signal has a second level.

3. The driving circuit of claim 1, further comprising:

a plurality of current sensors coupled to said LED light sources and for generating a plurality of monitoring signals indicating said currents respectively.

4. The driving circuit of claim 3, wherein said current balance controllers generate a plurality of driving signals to control a plurality of switches coupled in series with said LED light sources respectively.

5. The driving circuit of claim 4, wherein a duty cycle of a driving signal of said driving signals is determined based on said first reference signal and a corresponding monitoring signal of said monitoring signals.

6. The driving circuit of claim 4, wherein an amplitude of a driving signal of said driving signals is determined according to a difference between said second reference signal and a corresponding monitoring signal of said monitoring signals.

7. The driving circuit of claim 4, wherein a current balance controller of said current balance controllers comprises a first error amplifier for generating an error signal based upon a difference between said first reference signal and an average of a corresponding monitoring signal of said monitoring signals.

8. The driving circuit of claim 7, wherein said current balance controller further comprises a comparator coupled to said first error amplifier and for generating an enable signal by comparing said error signal to a ramp signal.

9. The driving circuit of claim 8, wherein said current balance controller further comprises a second error amplifier coupled to said comparator and for generating a corresponding driving signal of said driving signals by comparing said monitoring signal to said second reference signal when said second error amplifier is enabled by said enable signal.

10. The driving circuit of claim 8, wherein said first error amplifier compares said first reference signal to an average of said corresponding monitoring signal and said comparator compares said error signal to said ramp signal if a dimming signal has a first level, and wherein said first error amplifier and said comparator are disabled if said dimming signal has a second level.

11. The driving circuit of claim 4, wherein said driving signals comprise pulse-width modulation (PWM) signals.

12. The driving circuit of claim 3, further comprising:

a feedback selection circuit coupled between said power converter and said current balance controllers and for receiving said monitoring signals and determining an LED light source having a maximum forward voltage from said LED light sources, wherein said power converter is for adjusting said regulated voltage to satisfy a power need of said LED light source having said maximum forward voltage.

13. A controller for regulating a current through a light-emitting diode (LED) light source, said controller comprising:

a first reference pin for receiving a first reference signal indicative of a target average level; and a second reference pin for receiving a second reference signal indicative of a maximum transient level, wherein said controller regulates an average current of said current to said target average level and a transient level of said current within said maximum transient level.

14. The controller of claim 13, wherein a duty cycle of said current is determined according to said first reference signal.

15. The controller of claim 13, wherein an amplitude of said current is determined according to said second reference signal.

16. The controller of claim 13, further comprising:

a dimming control pin for receiving a dimming signal, wherein said current is determined according to said first reference signal and second reference signal if said dimming signal has a first level, and wherein said current is cut off if said dimming signal has a second level.

17. The controller of claim 13, further comprising:

a sensing pin for receiving a monitoring signal indicative of said current, wherein said controller compares an average of said monitoring signal to said first reference signal and compares said monitoring signal to said second reference signal.

18. A method for powering a plurality of light-emitting diode (LED) light sources, said method comprising:

applying a regulated voltage to said LED light sources to produce a plurality of currents flowing through said LED light sources respectively;

receiving a first reference signal indicative of a target average level;

receiving a second reference signal indicative of a maximum transient level; and regulating an average current of each of said currents to said target average level and a transient level of each of said currents within said maximum transient level.

19. The method of claim 18, wherein a plurality of duty cycles of said currents are determined according to said first reference signal.

20. The method of claim 18, wherein a plurality of amplitudes of said currents are determined according to said second reference signal.

* * * * *